US006532709B2

(12) United States Patent
Pervan

(10) Patent No.: US 6,532,709 B2
(45) **Date of Patent: *Mar. 18, 2003**

(54) LOCKING SYSTEM AND FLOORING BOARD

(75) Inventor: Darko Pervan, Viken (SE)

(73) Assignee: Valinge Aluminium AB, Viken (SE)

( * ) Notice: Subject to any disclaimer, the term of this patent is extended or adjusted under 35 U.S.C. 154(b) by 0 days.

This patent is subject to a terminal disclaimer.

(21) Appl. No.: 10/100,032

(22) Filed: Mar. 19, 2002

(65) Prior Publication Data

US 2002/0095894 A1 Jul. 25, 2002

Related U.S. Application Data

(63) Continuation of application No. 09/679,300, filed on Oct. 6, 2000, which is a continuation of application No. PCT/SE99/00734, filed on May 31, 1999.

(30) Foreign Application Priority Data

Jun. 3, 1998 (SE) ..... 9801986

(51) Int. Cl.[7] ..... E04F 15/22
(52) U.S. Cl. ..... 52/403.1; 52/480
(58) Field of Search ..... 52/403.1, 480, 52/506.05, 551, 748.1, 747.1, 747.11, 582.1, 592.2, 591.3

(56) References Cited

U.S. PATENT DOCUMENTS

| | | | |
|---|---|---|---|
| 213,740 | A | 4/1879 | Conner |
| 714,987 | A | 12/1902 | Wolfe |
| 753,791 | A | 3/1904 | Fulghum |
| 1,124,228 | A | 1/1915 | Houston |
| 1,407,679 | A | 2/1922 | Ruthrauff |
| 1,454,250 | A | 5/1923 | Parsons |
| 1,468,288 | A | 9/1923 | Een |
| 1,477,813 | A | 12/1923 | Daniels et al. |
| 1,510,924 | A | 10/1924 | Daniels |
| 1,540,128 | A | 6/1925 | Houston |

(List continued on next page.)

FOREIGN PATENT DOCUMENTS

| | | |
|---|---|---|
| AU | 713628 | 1/1998 |
| AU | 200020703 A1 | 6/2000 |
| BE | 417526 | 9/1936 |
| BE | 0557844 | 6/1957 |

(List continued on next page.)

OTHER PUBLICATIONS

Tony Pervan, U.S. patent application Ser. No. 09/534,007 entitled "*System for Joining Building Boards*" filed Mar. 24, 2000.

Darko Pervan, U.S. patent application Ser. No. 09/679,300 entitled "*Locking System and Flooring Board*" filed Oct. 6, 2000.

(List continued on next page.)

*Primary Examiner*—Lanna Mai
*Assistant Examiner*—Chi Q Nguyen
(74) *Attorney, Agent, or Firm*—Burns, Doane, Swecker & Mathis, L.L.P.

(57) ABSTRACT

A floorboard system includes a plurality of floorboards, wherein each of the floorboards is a rectangular floorboard provided with long edges and short edges and having a floorboard body provided with an integrated long edge locking system and an integrated short edge locking system for mechanical joining, both vertically and horizontally, the floorboards, along the long edges thereof and along the short edges thereof. The long edge locking system differs from the short edge locking system in respect of at least one of material composition and material properties. And, at least one of the long edge locking system and the short edge locking system includes a separate element which is integrally connected with the floorboard body at the factory and is made of a material other than that included in the floorboard body.

102 Claims, 7 Drawing Sheets

U.S. PATENT DOCUMENTS

| | | | |
|---|---|---|---|
| 1,575,821 | A | 3/1926 | Daniels |
| 1,602,256 | A | 10/1926 | Sellin |
| 1,602,267 | A | 10/1926 | Karwisch |
| 1,615,096 | A | 1/1927 | Meyers |
| 1,622,103 | A | 3/1927 | Fulton |
| 1,622,104 | A | 3/1927 | Fulton |
| 1,637,634 | A | 8/1927 | Carter |
| 1,644,710 | A | 10/1927 | Crooks |
| 1,660,480 | A | 2/1928 | Daniels |
| 1,714,738 | A | 5/1929 | Smith |
| 1,718,702 | A | 6/1929 | Pfiester |
| 1,734,826 | A | 11/1929 | Pick |
| 1,764,331 | A | 6/1930 | Moratz |
| 1,778,069 | A | 10/1930 | Fetz |
| 1,787,027 | A | 12/1930 | Wasleff |
| 1,823,039 | A | 9/1931 | Gruner |
| 1,859,667 | A | 5/1932 | Gruner |
| 1,898,364 | A | 2/1933 | Gynn |
| 1,906,411 | A | 5/1933 | Potvin |
| 1,929,871 | A | 10/1933 | Jones |
| 1,940,377 | A | 12/1933 | Storm |
| 1,953,306 | A | 4/1934 | Moratz |
| 1,986,739 | A | 1/1935 | Mitte |
| 1,988,201 | A | 1/1935 | Hall |
| 2,044,216 | A | 6/1936 | Klages |
| 2,276,071 | A | 3/1942 | Scull |
| 2,324,628 | A | 7/1943 | Kähr |
| 2,398,632 | A | 4/1946 | Frost et al. |
| 2,430,200 | A | 11/1947 | Wilson |
| 2,740,167 | A | 4/1956 | Rowley |
| 2,780,253 | A | 2/1957 | Joa |
| 2,894,292 | A | 7/1959 | Gramespacher |
| 3,045,294 | A | 7/1962 | Livezey, Jr. |
| 3,100,556 | A | 8/1963 | De Ridder |
| 3,125,138 | A | 3/1964 | Bolenbach |
| 3,182,769 | A | 5/1965 | De Ridder |
| 3,203,149 | A | 8/1965 | Soddy |
| 3,267,630 | A | 8/1966 | Omholt |
| 3,282,010 | A | 11/1966 | King, Jr. |
| 3,310,919 | A | 3/1967 | Bue et al. |
| 3,347,048 | A | 10/1967 | Brown et al. |
| 3,387,422 | A | 6/1968 | Wanzer |
| 3,460,304 | A | 8/1969 | Braeuninger et al. |
| 3,481,810 | A | 12/1969 | Waite |
| 3,526,420 | A | 9/1970 | Brancalone |
| 3,538,665 | A | 11/1970 | Gohner |
| 3,553,919 | A | 1/1971 | Omholt |
| 3,555,762 | A | 1/1971 | Costanzo, Jr. |
| 3,694,983 | A | 10/1972 | Couquet |
| 3,714,747 | A | 2/1973 | Curran |
| 3,731,445 | A | 5/1973 | Hoffman et al. |
| 3,759,007 | A | 9/1973 | Thiele |
| 3,768,846 | A | 10/1973 | Hensley et al. |
| 3,859,000 | A | 1/1975 | Webster |
| 3,902,293 | A | 9/1975 | Witt et al. |
| 3,908,053 | A | 9/1975 | Hettich |
| 3,936,551 | A | 2/1976 | Elmendorf et al. |
| 3,988,187 | A | 10/1976 | Witt et al. |
| 4,090,338 | A | 5/1978 | Bourgade |
| 4,099,358 | A | 7/1978 | Compaan |
| 4,169,688 | A | 10/1979 | Toshio |
| 4,242,390 | A | 12/1980 | Nemeth |
| 4,299,070 | A | 11/1981 | Oltmanns et al. |
| 4,426,820 | A | 1/1984 | Terbrack et al. |
| 4,471,012 | A | 9/1984 | Maxwell |
| 4,501,102 | A | 2/1985 | Knowles |
| 4,561,233 | A | 12/1985 | Harter et al. |
| 4,612,745 | A | 9/1986 | Hovde |
| 4,641,469 | A | 2/1987 | Wood |
| 4,653,242 | A | 3/1987 | Ezard |
| 4,703,597 | A | 11/1987 | Eggemar |
| 4,715,162 | A | 12/1987 | Brightwell |
| 4,738,071 | A | 4/1988 | Ezard |
| 4,769,963 | A | 9/1988 | Meyerson |
| 4,819,932 | A | 4/1989 | Trotter, Jr, |
| 4,831,806 | A | 5/1989 | Niese et al. |
| 4,845,907 | A | 7/1989 | Meek |
| 4,905,442 | A | 3/1990 | Daniels |
| 5,029,425 | A | 7/1991 | Bogataj |
| 5,113,632 | A | 5/1992 | Hanson |
| 5,117,603 | A | 6/1992 | Weintraub |
| 5,165,816 | A | 11/1992 | Parasin |
| 5,179,812 | A | 1/1993 | Hill |
| 5,216,861 | A | 6/1993 | Meyerson |
| 5,253,464 | A | 10/1993 | Nilsen |
| 5,271,564 | A | 12/1993 | Smith |
| 5,295,341 | A | 3/1994 | Kajiwara |
| 5,349,796 | A | 9/1994 | Meyerson |
| 5,390,457 | A | 2/1995 | Sjölander |
| 5,433,806 | A | 7/1995 | Pasquali et al. |
| 5,471,831 | A | 12/1995 | Nystrom |
| 5,497,589 | A | 3/1996 | Porter |
| 5,502,939 | A | 4/1996 | Zadok et al. |
| 5,540,025 | A | 7/1996 | Takehara et al. |
| 5,567,497 | A | 10/1996 | Zegler et al. |
| 5,570,554 | A | 11/1996 | Searer |
| 5,597,024 | A | 1/1997 | Bolyard et al. |
| 5,630,304 | A | 5/1997 | Austin |
| 5,671,575 | A | 9/1997 | Wu |
| 5,706,621 | A | 1/1998 | Pervan |
| 5,768,850 | A | 6/1998 | Chen |
| 5,797,237 | A | 8/1998 | Finkell, Jr. |
| 5,823,240 | A | 10/1998 | Bolyard et al. |
| 5,827,592 | A | 10/1998 | Van Gulik et al. |
| 5,860,267 | A | 1/1999 | Pervan |
| 5,935,668 | A | 8/1999 | Smith |
| 5,943,239 | A | 8/1999 | Shamblin et al. |
| 5,968,625 | A | 10/1999 | Hudson |
| 5,987,839 | A | 11/1999 | Hamar et al. |
| 6,006,486 | A | 12/1999 | Moriau |
| 6,094,882 | A | 8/2000 | Pervan |
| 6,101,778 | A | 8/2000 | Martensson |
| 6,119,423 | A | 9/2000 | Costantino |
| 6,134,854 | A | 10/2000 | Stanchfield |
| 6,148,884 | A | 11/2000 | Bolyard et al. |
| 6,182,410 | B1 | 2/2001 | Pervan |
| 6,205,639 | B1 | 3/2001 | Pervan |
| 6,209,278 | B1 | 4/2001 | Tychsen |
| 6,216,403 | B1 | 4/2001 | Belbeoc'h |
| 6,216,409 | B1 | 4/2001 | Roy et al. |
| 6,324,803 | B1 | 12/2001 | Pervan |
| 2001/0029720 | A1 | 10/2001 | Pervan |
| 2001/0034992 | A1 | 11/2001 | Pletzer et al. |
| 2002/0007608 | A1 | 1/2002 | Pervan |
| 2002/0007609 | A1 | 1/2002 | Pervan et al. |
| 2002/0020127 | A1 | 2/2002 | Thiers |
| 2002/0046528 | A1 | 4/2002 | Pervan et al. |

FOREIGN PATENT DOCUMENTS

| | | |
|---|---|---|
| BE | 1010339 A3 | 6/1998 |
| BE | 1010487 A6 | 10/1998 |
| CA | 0991373 | 6/1976 |
| CA | 2226286 | 12/1997 |
| CA | 2252791 | 5/1999 |
| CA | 2289309 | 7/2000 |
| CH | 200949 | 1/1939 |
| CH | 211877 | 1/1941 |
| DE | 1 212 275 | 3/1966 |
| DE | 7102476 | 1/1971 |
| DE | 1 534 278 | 11/1971 |
| DE | 7402354 | 1/1974 |

| | | | |
|---|---|---|---|
| DE | 2 238 660 | | 2/1974 |
| DE | 2 252 643 | | 5/1974 |
| DE | 2 502 992 | | 7/1976 |
| DE | 2 616 077 | | 10/1977 |
| DE | 2 917 025 | | 11/1980 |
| DE | 30 41781 | A1 | 6/1982 |
| DE | 32 14 207 | A1 | 11/1982 |
| DE | 32 46 376 | C2 | 6/1984 |
| DE | 3343601 | A1 | 6/1985 |
| DE | 8604004 | | 6/1986 |
| DE | 3512204 | A1 | 10/1986 |
| DE | 3544845 | A1 | 6/1987 |
| DE | 40 02 547 | A1 | 8/1991 |
| DE | 4134452 | A1 | 4/1993 |
| DE | 4215273 | A1 | 11/1993 |
| DE | 4242530 | A1 | 6/1994 |
| DE | 297 10 175 | U1 | 9/1997 |
| DE | 196 51 149 | A1 | 6/1998 |
| DE | 197 09 641 | | 9/1998 |
| DE | 200 01 225 | U1 | 8/2000 |
| DE | 200 02 744 | U1 | 9/2000 |
| DE | 199 25 248 | A1 | 12/2000 |
| DE | 200 17 461 | U1 | 3/2001 |
| DE | 200 18 284 | U1 | 3/2001 |
| EP | 0 248 127 | A1 | 12/1987 |
| EP | 0 623 724 | A1 | 11/1994 |
| EP | 0 652 340 | A1 | 5/1995 |
| EP | 0 690 185 | A1 | 1/1996 |
| EP | 0 698 162 | B1 | 2/1996 |
| EP | 0 843 763 | B1 | 5/1998 |
| EP | 0 849 416 | A2 | 6/1998 |
| EP | 0 855 482 | B1 | 7/1998 |
| EP | 0 877 130 | | 11/1998 |
| EP | 0 958 441 | | 11/1998 |
| EP | 0 903 451 | A2 | 3/1999 |
| EP | 0 969 163 | A3 | 1/2000 |
| EP | 0 969 163 | A2 | 1/2000 |
| EP | 0 969 164 | A2 | 1/2000 |
| EP | 0 969 164 | A3 | 1/2000 |
| EP | 0 974 713 | A1 | 1/2000 |
| FI | 843060 | | 8/1984 |
| FR | 1 293 043 | | 4/1962 |
| FR | 2 568 295 | | 1/1986 |
| FR | 2 630 149 | | 10/1989 |
| FR | 2 637 932 | A1 | 4/1990 |
| FR | 2 675 174 | | 10/1992 |
| FR | 2 691 491 | | 11/1993 |
| FR | 2 697 275 | | 4/1994 |
| FR | 2 712 329 | A1 | 5/1995 |
| FR | 2 782 513 | A1 | 1/2000 |
| FR | 2 785 633 | A1 | 5/2000 |
| GB | 424057 | | 2/1935 |
| GB | 585205 | | 1/1947 |
| GB | 599793 | | 3/1948 |
| GB | 636423 | | 4/1950 |
| GB | 812671 | | 4/1959 |
| GB | 1127915 | | 10/1968 |
| GB | 1237744 | | 6/1971 |
| GB | 1275511 | | 5/1972 |
| GB | 1430423 | | 3/1976 |
| GB | 2117813 | A | 10/1983 |
| GB | 2126106 | A | 3/1984 |
| GB | 2243381 | A | 10/1991 |
| GB | 2256023 | A | 11/1992 |
| JP | 54-65528 | | 5/1979 |
| JP | 57-119056 | | 7/1982 |
| JP | 59-186336 | | 11/1984 |
| JP | 3-169967 | | 7/1991 |
| JP | 4-106264 | | 4/1992 |
| JP | 5-148984 | | 6/1993 |
| JP | 6-56310 | | 5/1994 |
| JP | 6-146553 | A | 5/1994 |
| JP | 6-3205510 | | 11/1994 |
| JP | 7-076923 | A | 3/1995 |
| JP | 7-180333 | A | 7/1995 |
| JP | 7-300979 | A | 11/1995 |
| JP | 7-310426 | A | 11/1995 |
| NL | 7601773 | | 8/1976 |
| NO | 157871 | | 7/1984 |
| NO | 305614 | | 5/1995 |
| PL | 24931 | U | 11/1974 |
| PL | 26931 | U | 2/1990 |
| SE | 372 051 | | 5/1973 |
| SE | 450 141 | | 6/1984 |
| SE | 501 014 | C2 | 10/1994 |
| SE | 502 994 | | 3/1996 |
| SE | 506 254 | | 11/1997 |
| SE | 509 059 | | 6/1998 |
| SE | 509 060 | | 6/1998 |
| SE | 512 290 | | 12/1999 |
| SE | 512 313 | | 12/1999 |
| SE | 0000200-6 | | 7/2001 |
| SU | 363795 | | 11/1973 |
| WO | WO 84/02155 | | 6/1984 |
| WO | WO 87/03839 | A1 | 7/1987 |
| WO | WO 92/17657 | | 10/1992 |
| WO | WO 93/13280 | | 7/1993 |
| WO | WO 94/01628 | | 1/1994 |
| WO | WO 94/26999 | | 11/1994 |
| WO | WO 96/27719 | | 9/1996 |
| WO | WO 96/27721 | | 9/1996 |
| WO | WO 96/30177 | A1 | 10/1996 |
| WO | WO 97/47834 | | 12/1997 |
| WO | WO 98/24994 | | 6/1998 |
| WO | WO 98/24995 | | 6/1998 |
| WO | WO 98/38401 | A1 | 9/1998 |
| WO | WO 99/40273 | A1 | 8/1999 |
| WO | WO 99/66151 | | 12/1999 |
| WO | WO 99/66152 | | 12/1999 |
| WO | WO 00/06854 | | 1/2000 |
| WO | WO 00/66856 | A1 | 11/2000 |
| WO | WO 01/66876 | A1 | 9/2001 |

OTHER PUBLICATIONS

Darko Pervan, U.S. patent application Ser. No. 09/714,514 entitled "*Locking System an Flooring Board*" filed Nov. 17, 2000.

Darko Pervan, U.S. patent Application Ser. No. 10/043,149 entitled "*Floorboards And Methods For Production And Installation Thereof*" filed Jan. 14, 2002.

Darko Pervan, U.S. patent application Ser. No. 10/043,424 entitled "*Floorboards And Locking System Thereof*" filed Jan. 14, 2002.

Webster's Dictionary, Random House: New York (1987), p. 862.

Knight's American Mechanical Dictionary, Hurd and Houghton: New York (1876), p. 2051.

Opposition EP 0.698,162 B1—Facts–Grounds–Arguments, dated Apr. 1, 1999, pp. 1–56.

Opposition II EP 0.698,162 B1—Facts–Grounds–Arguments, dated Apr. 30, 1999, (17 pages)—with translation (11 pages).

Opposition I: Unilin Decor N.V./Välinge Aluminum AB, communication dated Jun. 8, 1999 to European Patent Office, pp. 1–2.

Opposition I: Unilin Decor N.V./Välinge Aluminum AB, communication dated Jun. 16, 1999 to European Patent Office, pp. 1–2.

FI Office Action dated Mar. 19, 1998.

NO Office Action dated Dec. 22, 1997.
NO Office Action dated Sep. 21, 1998.
Opposition EP 0.877.130 B1—Facts—Arguments, dated Jun. 28, 2000, pp. 1–13.
RU Application Examiner Letter dated Sep. 26, 1997.
NZ application Examiner Letter dated Oct. 21, 1999.
European prosecution file history to grant, European Patent No. 94915725.9—2303/0698162, grant date Sep. 16, 1998.
European prosecution file history to grant, European Patent No. 98106535.2–2303/0855482, grant date Dec. 1, 1999.
European prosecution file history to grant, European Patent No. 98201555.2303/0877130, grant date Jan. 26, 2000.
Communication of Notices of Intervention by E.F.P. Floor Products dated Mar. 17, 2000 in European Patent Application 0698162, pp. 1–11 with annex pp. 1–21.
Response to the E.F.P. Floor Products intervention dated Jun. 28, 2000, pp. 1–5.
Letters from the Opponent dated Jul. 26, 2001 and Jul. 30, 2001 including Annexes 1 to 3.
Communication from European Patent Office dated Sep. 20, 2001 in European Patent No. 0698162, pp. 1–12 with Facts and Submissions Annex pp. 1–18, Minutes Annex pp. 1–11, and Annex I to VI.
Communication from Swedish Patent Office dated Sep. 21, 2001 in Swedish Patent No. 9801986–2, pp. 1–3 in Swedish with forwarding letter dated Sep. 24, 2001 in English.
Pergo, Inc. v. Välinge Aluminium AB, Berry Finance NV, and Alloc, Inc.; U.S. District Court for the District of Columbia; Civil Action No. 1:00CV01618.
Alloc, Inc. v. Unilin Decor NV and BHK of America, Inc.; U.S. District Court for the Eastern District of Wisconsin; Civil Action No. 00–C–0999.
Unilin Beheer B.V., Unilin Decor, N.V., and DHK of America, Inc. Välinge Aluminium AB; U.S. U.S. District Court for the District of Columbia; Civil Action No. 1:00CVO1823.
Alloc, Inc. Berry Finance NV, and Välinge Aluminium AB v. Unilin Decor NV, BHK of America, Inc. BHK of America, Inc., Pergo, Inc., Meister–Leisten Schulte GmbH, Akzenta Paneele + Profile GmbH, Tarkett, Inc. and Roysol; ITC No. 337–TA–443 Filed Dec. 4, 2000.
Alloc, Inc. Berry Finance NV, and Välinge Aluminium AB v. Tarkett, U.S. District Court for the Eastern District of Wisconsin; Civil Action No. 00–CV–1377.
Välinge, Fibo–Trespo Brochure, Distributed at the Domotex Fair in Hannover, Germany, Jan. 1996.
Träindustrins Handbook "Snickeriarbete", 2nd Edition, Malmö 1952, pp. 826, 827, 854, and 855, published by Teknografiska Aktiebolaget, Sweden.
"Träbearbetning", Ander Grönlund, 1986, ISBN 91–970513–2, pp. 357–360, published by Institutet for Trateknisk Forskning, Stockholm, Sweden.
Drawing Figure 25/6107 from Buetec Gmbh dated Dec. 16, 1985.
Pamphlet from Serexhe for Compact–Praxis, entitled "Selbst Teppichböden, PVC und Parkett verlegen", Puiblished by Compact Verlag, München Germany 1985, pp. 84–87.
Pamphlet from Junckers Industrser A/S entitled "Bøjlesystemet til Junckers boliggulve" Oct. 1994., Published by Junckers Industrser A/S, Denmark.
Pamphlet from Junckers Industrser A/S entitled "The Clip System for Junckers Sports Floors", Annex 7, 1994, Published by Junckers Industrser A/S Denmark.
Pamphlet from Junckers Industrser A/S entiltled "The Clip System for Junckers Domestic Floors", Annex 8, 1994, Published by Junckers Industrser A/S, Denmark.
Fibo–Trespo Alloc System Brochure entitled "Oppæring OG Autorisasjon", pp. 1–29, Fibo–Trespo.
"Revolution bei der Laminatboden–Verl", boden wand decke, vol. No. 11 of 14, Jan. 10, 1997, p. 166.
Kährs Focus Extra dated Jan, 2001, pp. 1–9.
Brochure for CLIC Laminate Flooring, Art.–Nr. 110 11 640.
Brochure for Laminat–Boden "Clever–Click", Parador® Wohnsysteme.
Brochure for PERGO®, CLIC Laminate Flooring, and Prime Laminate Flooring from Bauhaus, The Home Store, Malmö, Sweden.

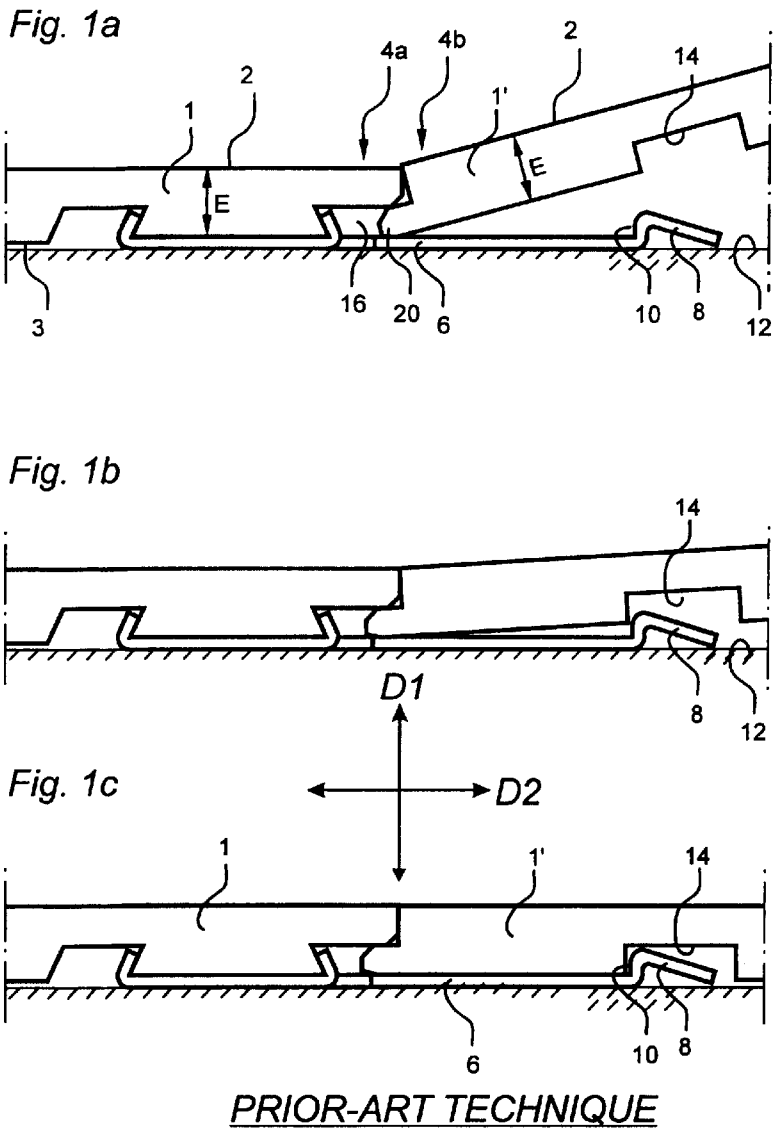
Fig. 1a
Fig. 1b
Fig. 1c
PRIOR-ART TECHNIQUE
D1
D2
E
1
1'
2
3
4a
4b
6
8
10
12
14
16
20
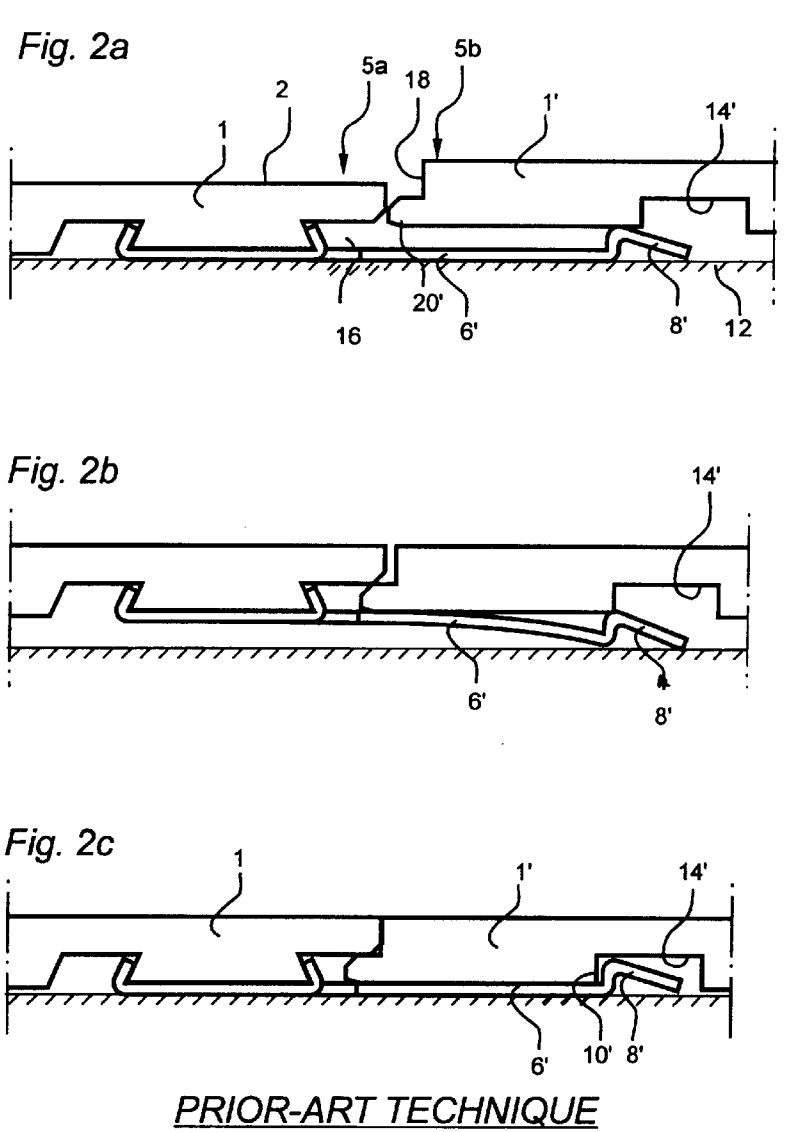
Fig. 2a
Fig. 2b
Fig. 2c
PRIOR-ART TECHNIQUE
1
1'
2
5a
5b
6'
8'
10'
12
14'
16
18
20'

PRIOR-ART TECHNIQUE

Fig. 6b
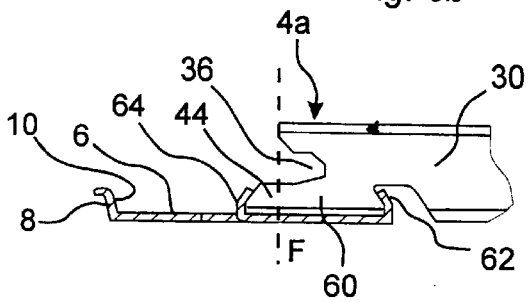
Fig. 5
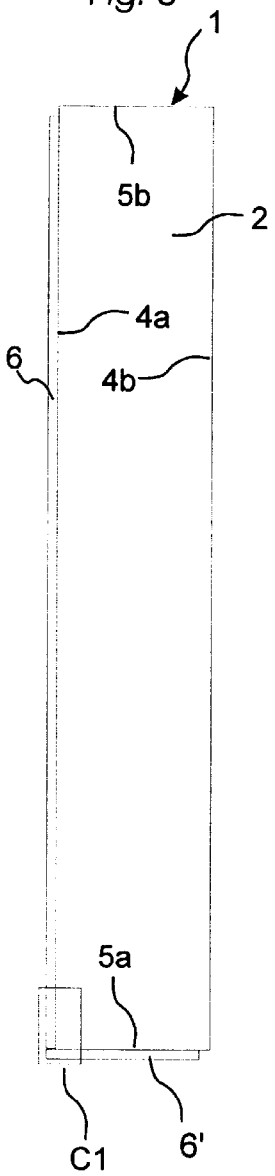
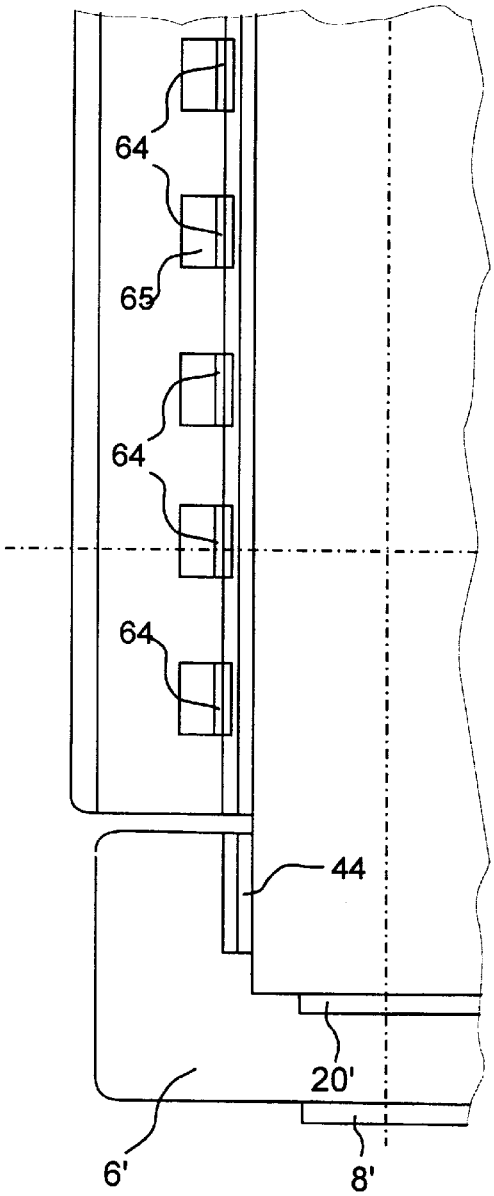
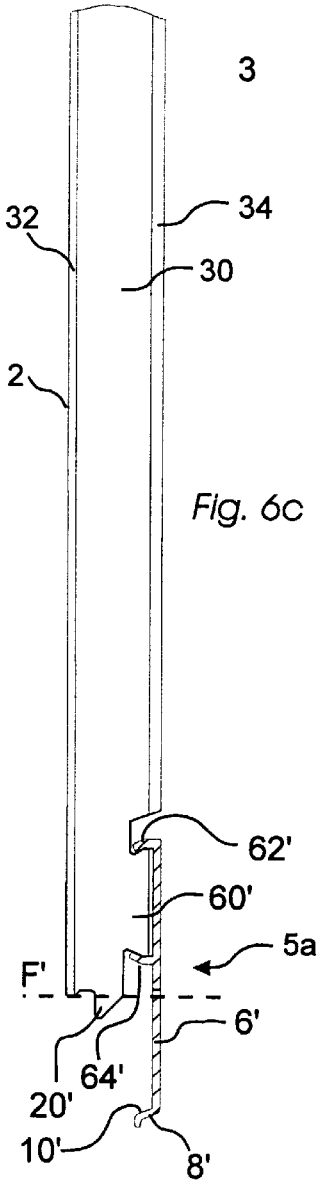
Fig. 6c
Fig. 6a

LOCKING SYSTEM AND FLOORING BOARD

This application is a continuation of U.S. application Ser. No. 09/679,300, filed on Oct. 6, 2000, which was a continuation of International Application No. PCT/SE99/00934, filed on May 31, 1999, which International Application was published by the International Bureau in English on Dec. 23, 1999. The entire contents of Ser. No. 09/679,300 is hereby incorporated by reference.

The invention generally relates to a locking system for providing mechanical joining of floorboards. More specifically, the invention concerns an improvement of a locking system of the type described and shown in WO 94/26999. The invention also relates to a floorboard provided with such a locking system. According to one more aspect of the invention, a floorboard with different designs of the locking system on long side and short side is provided.

FIELD OF THE INVENTION

The invention is particularly suited for mechanical joining of thin floating floorboards, such as laminate and parquet flooring, and therefore the following description of prior art and the objects and features of the invention will be directed to this field of application, in particular rectangular floorboards that are joined on long sides as well as short sides. The features distinguishing the invention concern in the first place parts of the locking system which are related to horizontal locking transversely of the joint edges of the boards. In practice, floorboards will be manufactured according to the inventive principles of also having locking means for mutual vertical locking of the boards.

BACKGROUND ART

WO 94/26999 discloses a locking system for mechanical joining of building boards, especially floorboards. A mechanical locking system permits locking together of the boards both perpendicular to and in parallel with the principal plane of the boards on long sides as well as short sides. Methods for making such floorboards are described in SE 9604484-7 and SE 9604483-9. The principles of designing and laying the floorboards as well as the methods for making the same that are described in the above three documents are applicable also to the present invention, and therefore the contents of these documents are incorporated by reference in present description.

With a view to facilitating the understanding and description of the present invention as well as the understanding of the problems behind the invention, now follows with reference to FIGS. 1–3 a brief description of floorboards according to WO 94/26999. This description of prior art should in applicable parts be considered to apply also to the following description of embodiments of the present invention.

A floorboard 1 of known design is shown from below and from above in FIGS. 3*a* and 3*b*, respectively. The board is rectangular and has a top side 2, an underside 3, two opposite long sides 4*a*, 4*b* which form joint edges, and two opposite short sides 5*a*, 5*b* which form joint edges.

Both the long sides 4*a*, 4*b* and the short sides 5*a*, 5*b* can be joined mechanically without any glue in the direction D2 in FIG. 1*c*. To this end, the board 1 has a planar strip 6 which is mounted at the factory and which extends horizontally from one long side 4*a*, the strip extending along the entire long side 4*a* and being made of a flexible, resilient aluminium sheet. The strip 6 can be mechanically fixed according to the illustrated embodiment, or fixed by means of glue or in some other fashion. Other strip materials can be used, such as sheet of some other metal, and aluminium or plastic sections. Alternatively, the strip 6 can be integrally formed with the board 1, for instance by some suitable working of the body of the board 1. The strip, however, is always integrated with the board 1, i.e. it is not mounted on the board 1 in connection with laying. The width of the strip 6 can be about 30 mm and its thickness about 0.5 mm. A similar, although shorter strip 6' is arranged also along one short side 5*a* of the board 1. The edge side of the strip 4 facing away from the joint edge 4*a* is formed with a locking element 8 extending along the entire strip 6. The locking element 8 has an active locking surface 10 facing the joint edge 4*a* and having a height of e.g. 0.5 mm. In connection with laying, the locking element 8 cooperates with a locking groove 14, which is formed in the underside 3 of the opposite long side 4*b* of an adjacent board 1'. The short side strip 6' is provided with a corresponding locking element 8', and the opposite short side 5*b* has a corresponding locking groove 14'.

For mechanical joining of both long sides and short sides also in the vertical direction (direction D1 in FIG. 1*c*), the board 1 is further along its one long side 4*a* and its one short side 5*a* formed with a laterally open recess 16. The recess 16 is defined downwards by the associated strip 6, 6'. At the opposite edges 4*b* and 5*b* there is an upper recess 18 defining a locking tongue 20 (see FIG. 2*a*) cooperating with the recess 16 to form a tongue-and-groove joint.

FIGS. 1*a*–1*c* show how two such boards 1, 1' can be joined by downwards angling. FIGS. 2*a*–2*c* show how the boards 1, 1' can instead be joined by snap action. The long sides 4*a*, 4*b* can be joined by both methods whereas the short sides 5*a*, 5*b*—after laying of the first row—are normally joined after joining of the long sides and merely by snap action. When a new board 1' and a previously laid board 1 are to be joined along their long sides according to FIGS. 1*a*–1*c*, the long side 4*b* of the new board 1' is pressed against the long side 4*a* of the previously laid board 1 according to FIG. 1*a*, so that the locking tongue 20 is inserted into the recess 16. The board 1' is then angled downwards to the subfloor 12 according to FIG. 1*b*. Now the locking tongue 20 completely enters the recess 16 while at the same time the locking element 8 of the strip 6 enters the locking groove 14. During this downwards angling, the upper part of the locking element 8 can be active and accomplish a guiding of the new board 1' towards the previously laid board 1. In the joined state according to FIG. 1*c*, the boards 1, 1' are locked in both D1 direction and D2 direction, but may be displaced relative to each other in the longitudinal direction of the joint.

FIGS. 2*a*–2*c* illustrate how also the short sides 5*a* and 5*b* of the boards 1, 1' can be mechanically joined in both D1 and D2 direction by the new board 1' being moved essentially horizontally towards the previously laid board 1. This can be carried out after the long side 4*b* of the new board 1' has been joined as described above. In the first step in FIG. 2*a*, bevelled surfaces adjacent to the recess 16 and the locking tongue 20 cooperate so that the strip 6' is forced downwards as a direct consequence of the joining of the short sides 5*a*, 5*b*. During the final joining, the strip 6' snaps upwards as the locking element 8' enters the locking groove 14'. By repeating the operations shown in FIGS. 1 and 2, the entire floor can be laid without glue and along all joint edges. Thus, prior-art floorboards of the above-mentioned type are joined mechanically by, as a rule, first being angled downwards on the long side, and when the long side is locked, the short sides are snapped together by horizontal displacement along the long side. The boards 1, 1' can be taken up again in reverse order, without the joint being damaged, and be laid once more.

For optimal function, it should be possible for the boards, after being joined, along their long sides to take a position where there is a possibility of a small play between the locking surface 10 and the locking groove 14. For a more detailed description of this play, reference is made to WO 94/26999.

In addition to the disclosure of the above-mentioned patent specifications, Norske Skog Flooring AS (licensee of Välinge Aluminium AB) introduced a laminate flooring with a mechanical joining system according to WO 94/29699 in January 1996 in connection with the Domotex fair in Hannover, Germany. This laminate flooring marketed under the trademark Alloc®, is 7.6 mm thick, has a 0.6 mm aluminium strip 6 which is mechanically fixed to the tongue side and the active locking surface 10 of the locking element 8 has an inclination of about 70°–80° to the plane of the board. The joint edges are impregnated with wax and the underside is provided with underlay board which is mounted at the factory. The vertical joint is designed as a modified tongue-and-groove joint. The strips 6, 6' on long side and short side are largely identical, but slightly bent upwards to different degrees on long side and short side. The inclination of the active locking surface varies between long side and short side. The distance of the locking groove 14 from the joint edge, however, is somewhat smaller on the short side than on the long side. The boards are made with a nominal play on the long side which is about 0.05–0.10 mm. This enables displacement of the long sides and bridges width tolerances of the boards. Boards of this brand have been manufactured and sold with zero play on the short sides, which is possible since the short sides need not be displaced in connection with the locking which is effected by snap action. Boards of this brand have also been made with more bevelled portions on the short side to facilitate snapping in according to FIGS. 2*a–c* above. It is thus known that the mechanical locking system can be designed in various ways and that long side and short side can be of different design.

WO 97/47834 (Unilin) discloses a mechanical joining system which is essentially based on the above known principles. In the corresponding product which this applicant began to market in the latter part of 1997, biasing between the boards is strived for. This leads to high friction and difficulties in angling together and displacing the boards. This document also shows that the mechanical locking on the short side can be designed in a manner different from the long side. In the described embodiments, the strip is integrated with the body of the board, i.e. made in one piece with and of the same material as the body of the board.

SUMMARY OF THE INVENTION

Although the flooring according to WO 94/26999 and the flooring marketed under the trademark Alloc® have great advantages compared with traditional, glued floorings, further improvements are desirable.

Mechanical joints are very suitable for joining not only laminate floorings, but also wood floorings and composite floorings. Such floorboards may consist of a large number of different materials in the surface, the core and the rear side, and as described above these materials can also be included in the strip of the joining system, the locking element on the strip, fixing surfaces, vertical joints etc. This solution involving an integrated strip, however, leads to costs in the form of waste when the mechanical joint is being made. Alternatively, special materials, such as the aluminium strip 6 above, can be glued or mechanically fixed to the floorboard to be included as components in the joining system. Different joint designs affect the costs to a considerable extent.

A strip made of the same material as the body of the board and formed by working of the body of the board can in some applications be less expensive than an aluminium strip, especially for floorboards in lower price ranges. Aluminium, however, is more advantageous in respect of flexibility, resilience and displaceability as well as accuracy in the positioning of the locking element. Aluminium also affords the possibility of making a stronger locking element. If the same strength is to be achieved with a locking element of wood fibre, it must be wide with a large shearing surface, which results in a large amount of waste material in manufacture, or it must be reinforced with a binder. Depending on the size of the boards, working of, for instance, 10 mm of a joint edge may result in six times higher cost of waste per $m^2$ of floor surface along the long sides compared with the short sides.

In addition to the above problems relating to undesirable waste of material, the present invention is based on the insight that the long sides and short sides can be optimised with regard to the specific locking functions that should be present in these joint edges.

As described above, locking of the long side is, as a rule, carried out by downwards angling. Also a small degree of bending down of the strip during locking can take place, as will be described in more detail below. Thanks to this downwards bending together with an inclination of the locking element, the boards can be angled down and up again with very tight joint edges. The locking element along the long sides should also have a high guiding capability so that the long side of a new board in connection with downwards angling is pushed towards the joint edge of the previously laid board. The locking element should have a large guiding part. For optimal function, the boards should along their long sides, after being joined, be able to take a mutual position transversely of the joint edges where there is a small play between locking element and locking groove.

On the other hand, locking of the short side is carried out by the long side being displaced so that the strip of the short side can be bent down and snap into the locking groove. Thus the short side must have means which accomplish downwards bending of the strip in connection with lateral displacement. The strength requirement is also higher on the short side. Guiding and displaceability are less important.

Summing up, there is a great need for providing a mechanical joint of the above type at a low cost and with optimal locking functions at each joint edge. It is not possible to achieve a low cost with prior-art solutions without also lowering the requirements as to strength and/or laying function. An object of the invention is to provide solutions which aim at lowering the cost with maintained strength and function. According to the invention, these and other objects are achieved by a locking system and a floorboard having the features as defined in independent claims 1, 18, 23 and 25. Preferred embodiments are stated in the respective dependent claims.

According to a first aspect of the invention (claim 1), a locking system for mechanical joining of floorboards is thus provided, where immediately juxtaposed upper parts of two adjacent joint edges of two joined floorboards together define a joint plane perpendicular to the principal plane of the floor boards. To obtain a joining of the two joint edges perpendicular to the joint plane, the locking system comprises in a manner known per se a locking groove which is formed in the underside of and extends in parallel with the first joint edge at a distance from the joint plane, and a portion projecting from the lower part of the second joint edge and below the first joint edge and integrated with a body of the board, said projecting portion supporting at a distance from the joint plane a locking element cooperating with the locking groove and thus positioned entirely outside the joint plane seen from the side of the second joint edge, said projecting portion having a different composition of materials compared with the body of the board. The inventive locking system is characterised in that the projecting portion presents at least two horizontally juxtaposed parts, which differ from each other at least in respect of the parameters material composition and material properties.

In a first embodiment of the first aspect of the invention, said at least two parts of the projecting portion are located at different distances from the joint plane. In particular, they may comprise an inner part closest to the joint plane and an outer part at a distance from the joint plane. The inner part and the outer part are preferably, but not necessarily, of equal length in the joint direction. In this first aspect of the invention, a material other than that included in the body is thus included in the joining system, and in particular the outer part can be at least partially formed of a separate strip which is made of a material other than that of the body of the board and which is integrally connected with the board by being factory-mounted. The inner part can be formed at least partially of a worked part of the body of the board and partially of part of said separate strip. The separate strip can be attached to such a worked part of the board body. The strip can be located entirely outside said joint plane, but can also intersect the joint plane and extend under the joint edge to be attached to the body also inside the joint plane.

This embodiment of the invention thus provides a kind of combination strip in terms of material, for example a projecting portion comprising an inner part with the material combination wood fibre/rear laminate/alumnium, and an outer part of aluminium sheet.

It is also possible to make the projecting part from three parts which are different in terms of material: an inner part closest to the joint plane, a central part and an outer part furthest away from the joint plane. The inner part and the outer part can possibly be equal in terms of material.

The portion projecting outside the joint plane need not necessarily be continuous or unbroken along the joint edge. A conceivable variant is that the projecting portion has a plurality of separate sections distributed along the joint edge. As an example, this can be accomplished by means of a separate strip with a continuous inner part and a toothed outer part, said strip being attachable to a part of the board body, said part being worked outside the joint plane.

In an alternative embodiment of the first aspect of the invention, said at least two parts, which differ in respect of at least one of the parameters material composition and material properties, are instead juxtaposed seen in the direction parallel with the joint edges. For example, there may be a plurality of strip types on one and the same side, where each strip type is optimised for a special function, such as strength and guiding in connection with laying. As an example, the strips can be made of different aluminium alloys and/or of aluminium having different states (for instance, as a result of different types of heat treatment).

According to a second aspect of the invention (claim 18), a locking system for mechanical joining of floorboards is provided. In this second aspect of the invention, the projecting portion is instead formed in one piece with the body of the board and thus has the same material composition as the body of the board. This second aspect of the invention is characterised in that the projecting portion, as a direct consequence of machining of its upper side, presents at least two horizontally juxtaposed parts, which differ from each other in respect of at least one of the parameters material composition and material properties.

The inventive principle of dividing the projecting portion into several parts which differ from each other in terms of material and/or material properties thus is applicable also to the prior-art "wood fibre strip".

In the same manner as described above for the first aspect of the invention, these two parts can be located at different distances from the joint plane, and especially there may be three or more parts with different material composition and/or material properties. Optionally, two such parts can be equal in respect of said parameters, but they may differ from a third.

In one embodiment, said two parts may comprise an inner part closest to the joint plane and an outer part at a distance from the joint plane. There may be further parts outside the outer part. Specifically, an outer part can be formed of fewer materials than an inner part. For instance, the inner part may consist or wood fibre and rear laminate, whereas the outer part, by machining from above, consists of rear laminate only. In one embodiment, the projecting portion may comprise—seen from the joint plane outwards—an inner part, an outer part and, outside the outer part, a locking element supported by the outer part. The locking element may differ from both inner and outer part in respect of said material parameters.

The projecting portion may consist of three laminated layers, and therefore it is possible, by working from above, to provide a locking system which, counted from the top, has a relatively soft upper guiding part which need not have any particular strength, a harder central part which forms a strong active locking surface and absorbs shear forces in the locking element, and a lower part which is connected with the rest of the projecting portion and which can be thin, strong and resilient.

Laminated embodiments can be suitable in such floorboards where the body of the board consists of, for instance, plywood or particle board with several layers. Corresponding layers can be found in the walls of the locking groove. For plywood, the material properties can be varied by changing the direction of fibres in the layers. For particle board, the material properties can be varied by using different chip dimensions and/or a binder in the different layers. The board body can generally consist of layers of different plastic materials.

In the definition of the invention, the term "projecting portion" relates to the part or parts of the board projecting outside the joint plane and having a function in the locking system in respect of supporting of locking element, strength, flexibility etc.

An underlay of underlay board, foam, felt or the like can, for instance, be mounted even in the manufacture of the boards on the underside thereof. The underlay can cover the underside up to the locking element, so that the joint between the underlays will be offset relative to the joint plane F. Although such an underlay is positioned outside the joint plane, it should thus not be considered to be included in the definition of the projecting portion in the appended claims.

In the aspect of the invention which relates to embodiments with a projecting portion of the same material as the body of the board, any thin material layers which remain after working from above should in the same manner not be considered to be included in the "projecting portion" in the cases where such layers do not contribute to the locking function in respect of strength, flexibility, etc. The same discussion applies to thin glue layers, binders, chemicals, etc. which are applied, for instance, to improve moisture proofing and strength.

According to a third aspect of the invention (claim 23) there is provided a floorboard presenting a locking system according to the first aspect or the second aspect of the invention as defined above. Several possibilities of combining prior-art separate strips, prior-art wood fibre strips and "combination strips" according to the invention are available. These possibilities can be used optionally on long side and short side.

For the above aspects, the projecting portion of a given joint edge, for instance a long side, has at least two parts with different material composition and/or material properties. For optimisation of a floorboard, such a difference in materials and/or material properties, however, may be considered to exist between the long sides and short sides of the board instead of within one and the same joint edge.

According to a fourth aspect of the invention (claim 25), a rectangular floorboard is thus provided, comprising a body and first and second locking means integrated with the body and adapted to provide a mechanical joining of adjacent joint edges of such floorboards along long sides and short sides, respectively, of the boards in a direction perpendicular to the respective joint edges and in parallel with the principal plane of the floorboards. According to this aspect of the invention, the floorboard is characterised in that said first and second locking means differ in respect of at least one of the parameters material composition and material properties. Preferably, said first and second locking means each comprise on the one hand a portion which projects from a joint edge and which at a distance from the joint edge supports a locking element and, on the other hand, a locking groove, which is formed in the underside of the body at an opposite joint edge for engaging such a locking element of an adjacent board. At least one of said locking means on the long side and the short side may comprise a separate element which is integrally fixed to the body of the board at the factory and is made of a material other than that included in the body of the board. The other locking means may comprise an element which is formed in one piece with the body of the board.

Within the scope of the fourth aspect of the invention, there are several possibilities of combination. For example, it is possible to select an aluminium strip for the long side and a machined wood fibre strip for the short side or vice versa. Another example is that for the short side or the long side a "combination strip" according to the first and the second aspect of the invention is selected, and for the other side a "pure" aluminium strip or a "pure" worked wood fibre strip is selected.

The above problem of undesirable costs of material is solved according to the invention by the projecting portion being made of different materials and/or material combinations and thus specially adaptable to the selected materials in the floorboard and the function and strength requirements that apply to the specific floorboard and that are specific for long side and short side. This advantage of the invention will be evident from the following description.

Since different requirements are placed on the long side and the short side and also the cost of waste differs, improvements can also be achieved by the long side and the short side being made of different materials or combinations of materials. In some applications, the long side can have, for instance, an aluminium strip with high guiding capability and low friction whereas the short side can have a wood fibre strip. In other applications, the opposite is advantageous.

In some applications, there may also be a need for different types of strip on the same side. The side may consist of, for instance, a plurality of different strips which are made of different aluminium alloys, have different thicknesses etc. and in which certain parts are intended to achieve high strength and others are intended to be used for guiding.

Different aspects of the invention will now be described in more detail by way of examples with reference to the accompanying drawings. The parts of the inventive board which are equivalent to those of the prior-art board in. FIGS. 1–3 are provided with the same reference numerals.

DESCRIPTION OF THE DRAWINGS

FIGS. 1*a–c* illustrate in three steps a downwards angling method for mechanical joining of long sides of floorboards according to WO 94/26999.

FIGS. 2*a–c* illustrate in three steps a snap-in method for mechanical joining of short sides of floorboards according to WO 4/26999.

FIG. 5 is a top plan view of a floorboard according to FIG. 4.

FIG. 6*a* shows on a larger scale a broken-away corner portion C1 of the board in FIG. 5, and FIGS. 6*b* and 6*c* are vertical sections of the joint edges along the long side 4*a* and the short side 5*a* of the board in FIG. 5, from which it is particularly evident that the long side and the short side different.

DESCRIPTION OF PREFERRED EMBODIMENTS

A first preferred embodiment of a floorboard 1 provided with a locking system according to the invention will now be described with reference to FIGS. 4–7. The shown example also illustrates the aspect of the invention which concerns differently designed locking systems for long side and short side.

Figure 4:
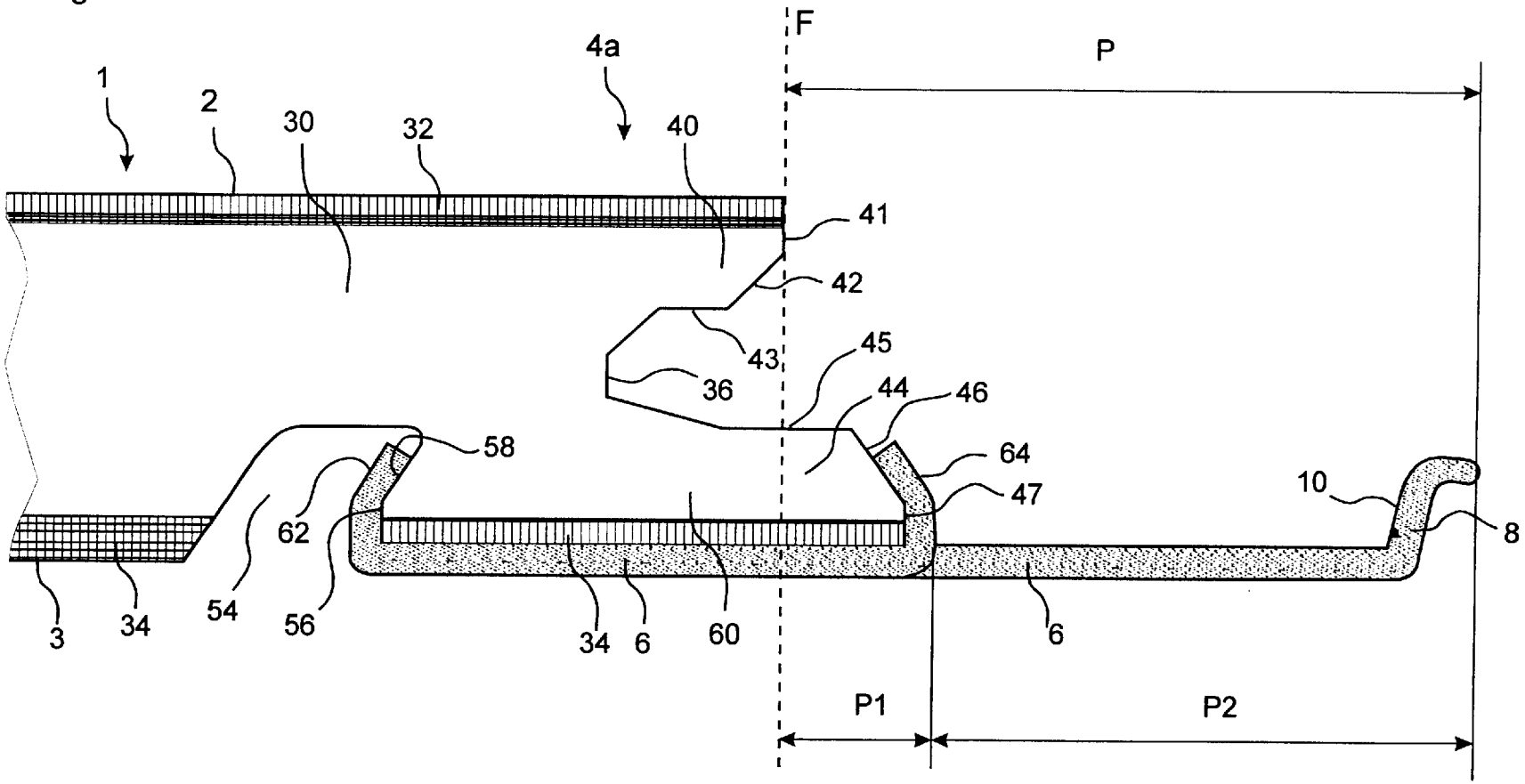
FIG. 4 shows a floorboard with a locking system according to a first embodiment of the invention.

FIG. 4 is a cross-sectional view of a long side 4*a* of the board 1. The body of the board 1 consists of a core 30 of, for instance, wood fibre which supports a surface laminate 32 on its front side and a balance layer 34 on its rear side. The board body 30–34 is rectangular with long sides 4*a*, 4*b* and short sides 5*a*, 5*b*. A separate strip 6 with a formed locking element 8 is mounted at the factory on the body 30–34, so that the strip 6 constitutes an integrated part of the completed floorboard 1. In the shown example, the strip 6 is made of resilient aluminium sheet. As an illustrative, non-limiting example, the aluminium sheet can have a thickness in the order of 0.6 mm and the floorboard a thickness in the order of 7 mm. For further description of dimensions, possible materials, etc. for the strip 6, reference is made to the above description of the prior-art board.

Figure 7A:
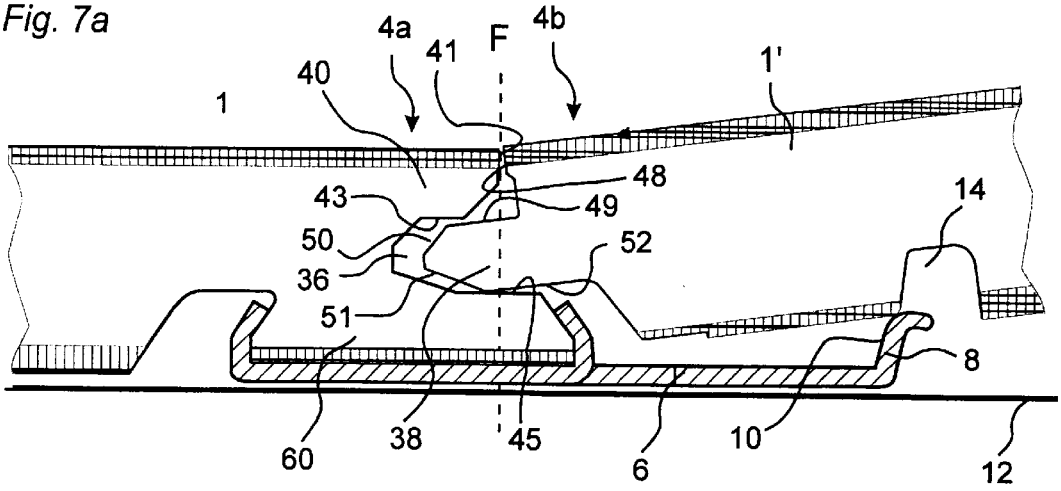
FIGS. 7*a–c* show a downwards angling method for mechanical joining of long sides of the floorboard according to FIGS. 4–6.
Figure 7B:
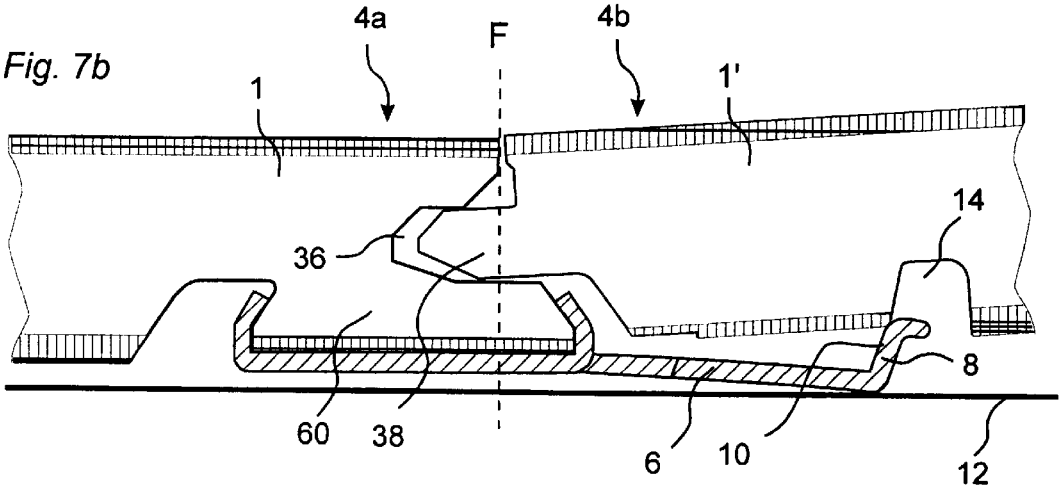
Figure 7C:
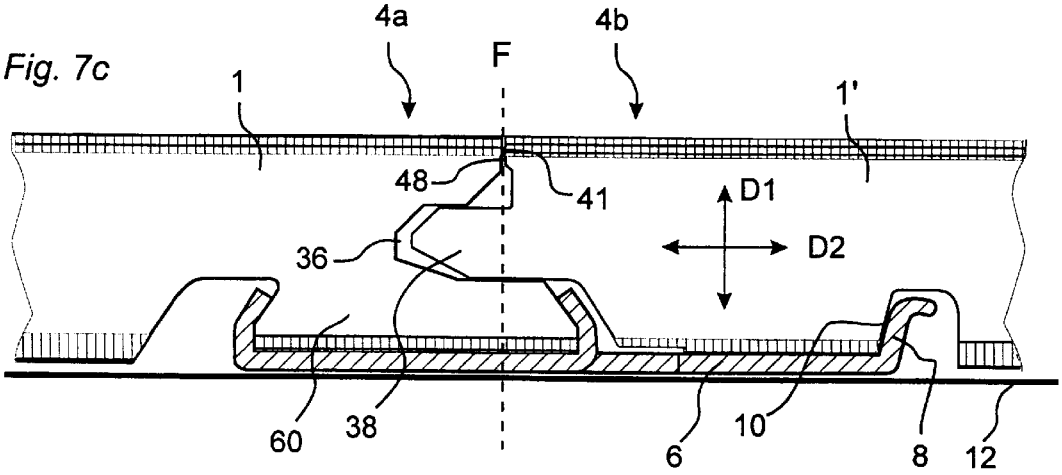

The strip 6 is formed with a locking element 8, whose active locking surface 10 cooperates with a locking groove 14 in an opposite joint edge 4*b* of an adjacent board 1' for horizontal locking together of the boards 1, 1' transversely of the joint edge (D2). With a view to forming a vertical lock in the D1 direction, the joint edge 4*a* has a laterally open groove 36 and the opposite joint edge 4*b* has a laterally projecting tongue 38 (corresponding to the locking tongue 20), which in the joined state is received in the groove 36 (FIG. 7*c*). The free surface of the upper part 40 of the groove 36 has a vertical upper portion 41, a bevelled portion 42 and an upper abutment surface 43 for the tongue 38. The free surface of the lower part 44 of the groove 36 has a lower abutment surface 45 for the tongue 38, a bevelled portion 46 and a lower vertical portion 47. The opposite joint edge 4*b* (see FIG. 7*a*) has an upper vertical portion 48, and the tongue 38 has an upper abutment surface 49, an upper bevelled portion 50, a lower bevelled portion 51 and a lower abutment surface 52.

In the joined state (FIG. 7*c*), the two juxtaposed vertical upper portions 41 and 48 define a vertical joint plane F. As is best seen from FIG. 4, the lower part 44 of the groove 36 is extended a distance outside the joint plane F. The joint edge 4*a* is in its underside formed with a continuous mounting groove 54 having a vertical lower gripping edge 56 and an inclined gripping edge 58. The gripping edges formed of the surfaces 46, 47, 56, 58 together define a fixing shoulder 60 for mechanical fixing of the strip 6. The fixing is carried out according to the same principle as in the prior-art board and can be carried out by means of the methods that are described in the above-mentioned documents. A continuous lip 62 of the strip 6 thus is bent round the gripping edges 56, 58 of the groove 54, while a plurality of punched tongues 64 are bent round the surfaces 46, 47 of the projecting portion 44. The tongues 64 and the associated punched holes 65 are shown in the broken-out view in FIG. 6*a*.

Figure 3A:
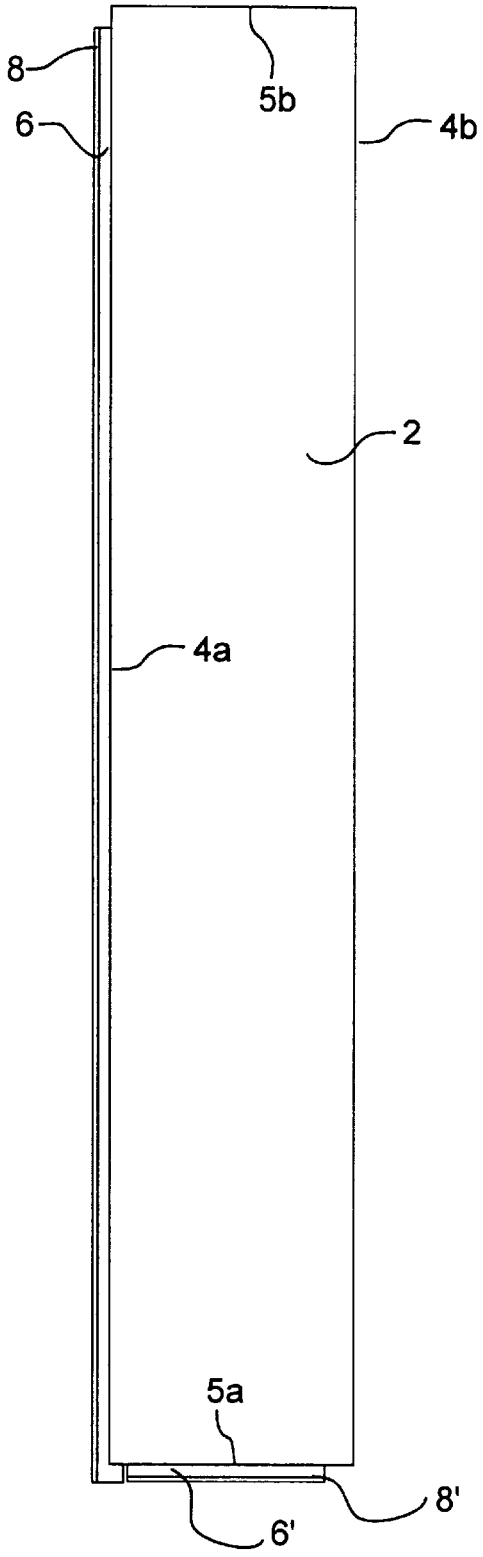
FIGS. 3 and 3*b* show a floorboard according to WO 94/26999 seen from above and from below, respectively.
Figure 3B:
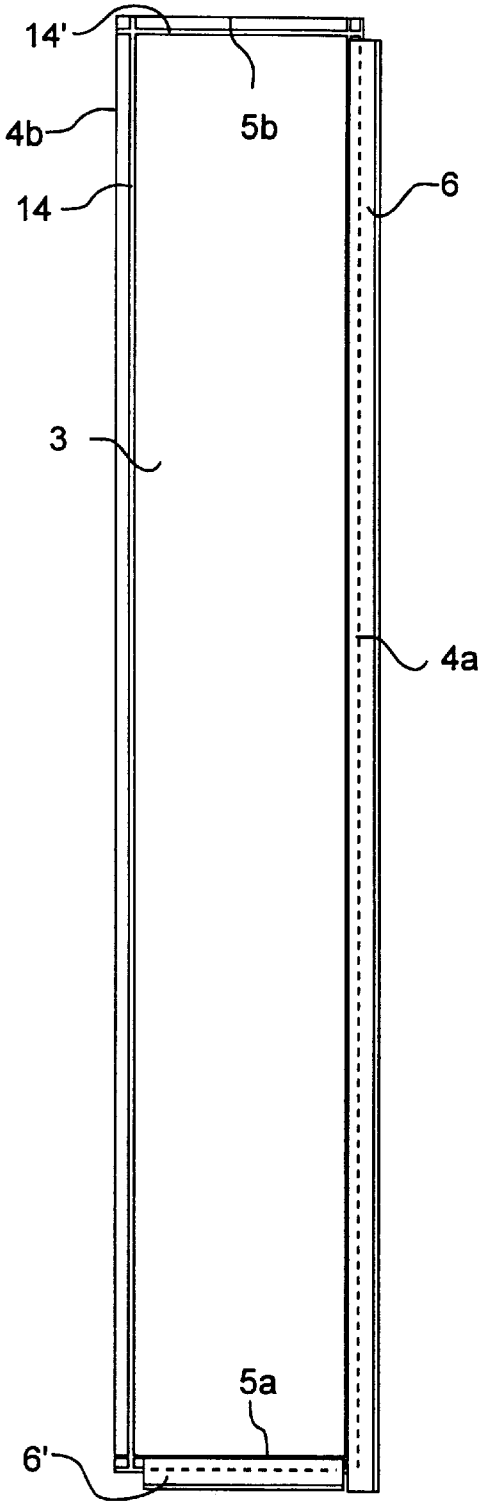

There is a significant difference between the inventive floorboard shown in FIGS. 4–7 and the prior-art board according to FIGS. 1–3. The area P in FIG. 4 designates the portion of the board 1 which is positioned outside the joint plane 1. According to the invention, the portion P has two horizontally juxtaposed parts P1 and P2, which differ in respect of at least one of the parameters material composition and material properties. More specifically, the inner part P1 is, closest to the joint plane F, formed partially of the strip 6 and partially of the worked part 44 of the body. In this embodiment, the inner part P1 thus comprises the material combination aluminium+wood fibre core+rear laminate whereas the outer part P2 is a made of aluminium only. In the prior-art board 1 in FIGS. 1*a–c*, the corresponding portion outside the joint plane is made of aluminium only.

As described above, this feature of the invention means that the cost of material can be reduced. Thanks to the fact that the fixing shoulder 60 is displaced towards the locking element 8 to such an extent that it is positioned at least partially outside the joint plane F, a considerable saving can be achieved in respect of the consumption of aluminium sheet. A saving in the order of 25% is possible. This embodiment is particularly advantageous in cheaper floorboards where waste of wood fibre as a result of machining of the body is preferred to a high consumption of aluminium sheet. The waste of material, however, is limited thanks to the fact that the projecting portion can also be used as abutment surface for the tongue, which can then be made correspondingly narrower perpendicular to the joint plane with the ensuing reduced waste of material on the tongue side.

This constructional change to achieve saving in material does not have a detrimental effect on the possibility of resilient vertical motion that must exist in the projecting portion P. The strength of the locking element 8 is not affected either. The outer part P2 of aluminium is still fully resilient in the vertical direction, and the short sides 5*a*, 5*b* can be snapped together according to the same principle as in FIGS. 2*a–c*. The locking element 8 is still made of aluminium and its strength is not reduced. However, it may be noted that the degree of resilience can be affected since it is essentially only the outer part P2 that is resilient in the snap action. This can be an advantage in some cases if one wants to restrict the bending-down properties and increase the strength of the lock.

The angling together of the long sides 4*a*, 4*b* can also be carried out according to the same principle as in FIGS. 1*a–c*. In general—not only in this embodiment—a small degree of downwards bending of the strip 6 may occur, as shown in the laying sequence in FIGS. 7*a–c*. This downwards bending of the strip 6 together with an inclination of the locking element 8 makes it possible for the boards 1, 1' to be angled down and up again with very tight joint edges at the upper surfaces 41 and 48. The locking element 8 should preferably have a high guiding capability so that the boards, in connection with downwards angling, are pushed towards the joint edge. The locking element 8 should have a large guiding part. For optimal function, the boards should, after being joined and along their long sides 4*a*, 4*b*, be able to take a position where there is a small play between locking element and locking groove, which need not be greater than about 0.02–0.05 mm. This play permits displacement and bridges width tolerances. The friction in the joint should be low.

In the joined state according to FIG. 7*c*, the boards 1, 1' are locked relative to each other in The vertical direction D1. An upwards movement of the board 1' is counteracted by engagement between the surfaces 43 and 49, while a downwards movement of the board 1' is counteracted on the one hand by engagement between the surfaces 45 and 52 and, on the other hand, by the board 1 resting on the upper side of the strip 6.

Figure 8:
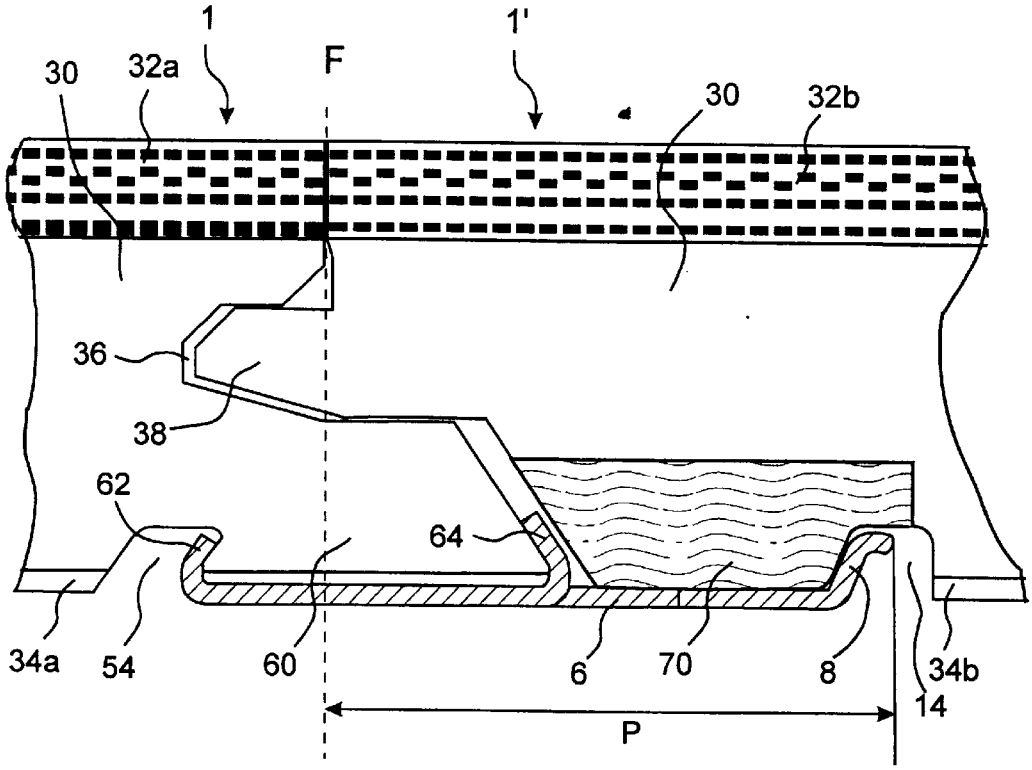
FIG. 8 shows two joined floorboards provided with a locking system according to a second embodiment of the invention.

FIG. 8 shows a second embodiment of the invention. The board 1 in FIG. 8 can be used for parquet flooring. The board 1 consists of an upper wear layer 32*a*, a core 30 and a rear balance layer 34*a*. In this embodiment, the projecting portion P outside the joint plane F is to a still greater extent made of different combinations of materials. The locking groove 14 is reinforced by the use of a separate component 70 of, for instance, wood fibre, which in a suitable manner is connected with the joint edge, for instance by gluing. This variant can be used, for instance, on the short side 5*b* of the board 1. Moreover, a large part of the fixing shoulder 60 is positioned outside the joint F.

Figure 9:
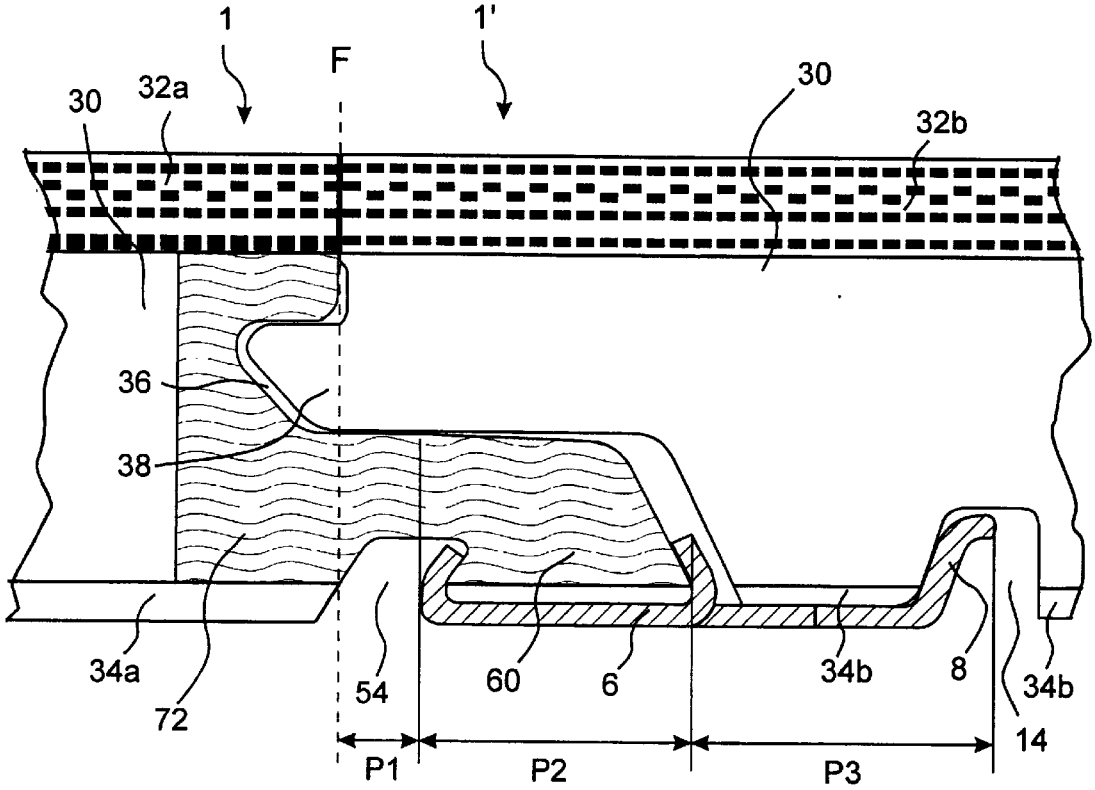
FIG. 9 shows two joined floorboards provided with a locking system according to a third embodiment of the invention.

FIG. 9 shows a third embodiment of the invention. The board 1 in FIG. 9 is usable to provide a strong attachment of the aluminium strip 6. In this embodiment, a separate part 72 is arranged on the joint edge supporting the locking element 8. The part 72 can be made of, for instance, wood fibre. The entire fixing shoulder 60 and the entire strip 6 are located outside the joint plane F. Only a small part of the separate strip 6 is used for resilience. From the viewpoint of material, the portion P located outside the joint plane F has three different areas containing the combinations of materials "wood fibre only" (P1), "wood fibre/balance layer/aluminium" (P2) and "aluminium only" (P3). This embodiment with the fixing shoulder 6 positioned entirely outside the joint plane F can also be accomplished merely by working the body of the board, i.e. without the separate part 72. The embodiment in FIG. 9 can be suitable for the long side. The locking element 8 has a large guiding part, and the projecting portion P outside the joint plane F has a reduced bending down capability.

When comparing the embodiments in FIGS. 8 and 9, it may be noted that in FIG. 9 the tongues 64 are higher than the lip 62. This results in a strong attachment of the strip 6 in the front edge of the fixing shoulder 60, which is advantageous when bending down the strip 6. This can be achieved without any extra cost of material since the tongues 64 are punched from the existing material. On the other hand, the lip 62 can be made lower, which is advantageous in respect of on the one hand consumption of material and, on the other hand, the weakening effect of the mounting groove 54 on the joint edge. It should further be noted that the locking element 8 in FIG. 8 is lower, which facilitates the snapping in on the short sides.

Figure 10:
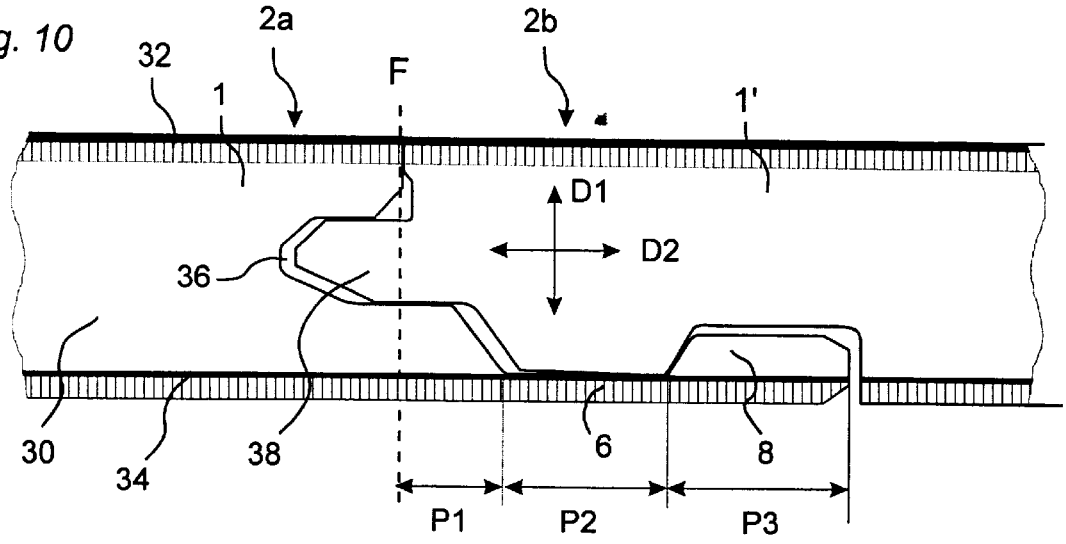
FIGS. 10–12 illustrate three different embodiments of floorboards according to the invention where the projecting portion is formed in one piece with the body of the board.
Figure 11:
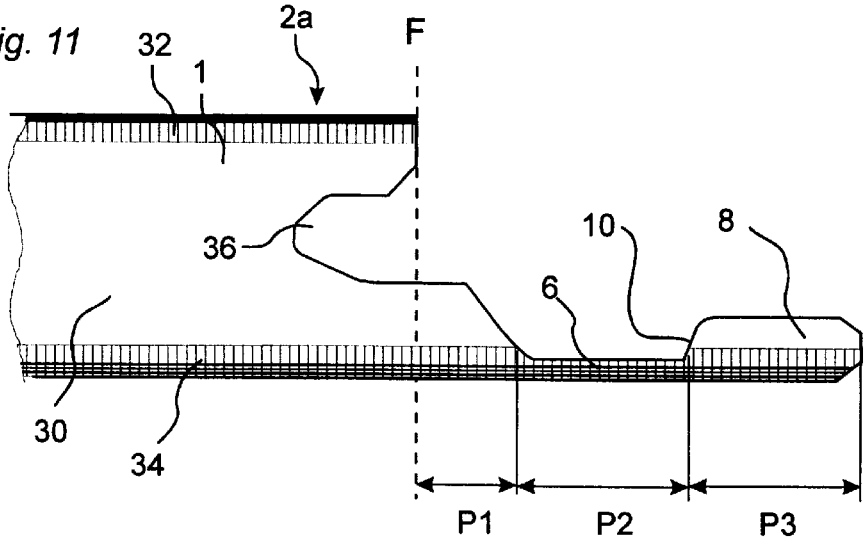
Figure 12:
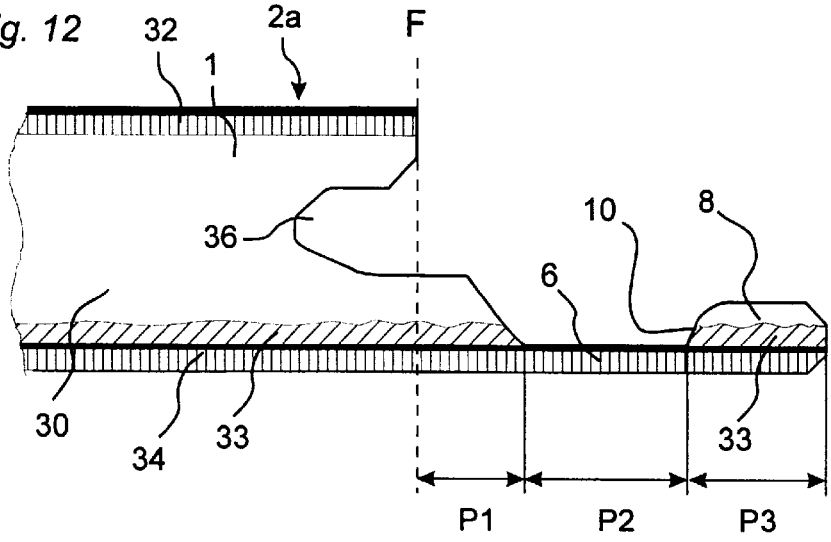

FIGS. 10–12 show three different embodiments of the invention, in which the projecting portion can be made in one piece with the board body or consists of separate materials which are glued to the edge of the board and are machined from above. Separate materials are particularly suitable on the short side where strength and resilience requirements are high. Such an embodiment means that the composition of materials on the long side and the short side can be different.

The above technique of providing the edge of the body, on the long side and/or short sides with separate materials that are fixed to the body to achieve special functions, such as strength, moisture proofing, flexibility etc, can be used also without utilising the principles of the invention. In other words, it is possible also in other joining systems, especially mechanical joining systems, to provide the body with separate materials in this way. In particular, this material can be applied as an edge portion, which in some suitable fashion is attached to the edge of the body and which can extend over the height of the entire board or parts thereof.

In a preferred embodiment, the edge portion is applied to the body before the body is provided with all outer layers, such as top layer and rear balance layer. Especially, such layers can then be applied on top of the fixed, separate edge portion, whereupon the latter can be subjected to working in respect of form with a view to forming part of the joining system, such as the projecting portion with locking element and/or the tongue with locking groove.

In FIGS. 10 and 11, the board body is composed of a top laminate 32, a wood fibre core 30 and a rear laminate 34. The locking element 8 is formed by the projecting portion P being worked from above in such manner that, seen from the joint plane F outwards, it has an inner part P1 consisting of wood fibre 30 and laminate 34, a central part P2 consisting of laminate 34 only, and an outer part P3 consisting of wood fibre and laminate 34.

The embodiments in FIGS. 10 and 11 differ from each other owing to the fact that in FIG. 10 the boundary between the wood fibre core 30 and the rear laminate 34 is on a vertical level with the lower edge of the active locking surface 10. Thus, in FIG. 10 no significant working of the rear laminate 34 has taken place in the central part P2. On the other hand, in FIG. 11 also the rear laminate 34 has been worked in the central part P2, which gives the advantage that the active locking surface 10 of the locking element 8 is wholly or partly made of a harder material.

The embodiment in FIG. 12 differs from the embodiments in FIGS. 10 and 11 by an additional intermediate layer 33 being arranged between the wood fibre core 30 and the rear laminate 34. The intermediate layer 33 should be relatively hard and strong to reinforce the active locking surface 10 as shown in FIG. 12. For example, the immediate layer 33 can be made of a separate material which is glued to the inner core. Alternatively, the immediate layer 33 may constitute a part of, for instance, a particle board core, where chip material and binder have been specially adapted to the mechanical joining system. In this alternative, the core and the intermediate layer 33 can thus both be made of chip material, but with different properties. The layers can be optimised for the different functions of the locking system.

Moreover, the aspects of the invention including a separate strip can preferably be implemented in combination with the use of an equalising groove of the type described in WO 94/26999. Adjacent joint edges are equalised in the thickness direction by working of the underside, so that the upper sides of the floorboards are flush when the boards are joined. Reference letter E in FIG. 1*a* indicates that the body of the boards after such working has the same thickness in adjacent joint edges. The strip 6 is received in the groove and will thus be partly flush-mounted in the underside of the floor. A corresponding arrangement can thus be accomplished also in combination with the invention as shown in the drawings.

What is claimed is:

1. A floorboard system comprising a plurality of floorboards, wherein each of the plurality of floorboards is a rectangular floorboard provided with long edges and short edges and a locking system for mechanical joining, both vertically and horizontally, the floorboards along the long edges as well as the short edges thereof, wherein immediately juxtaposed upper parts of each pair of joined long edges of the mechanically joined floorboards together define a long joint plane which is perpendicular to a principal plane of the joined floorboards, and immediately juxtaposed upper parts of each pair of joined short edges of the mechanically joined floorboards together define a short joint plane which is perpendicular to a principal plane of the joined floorboards;

each pair of joined long edges comprises:

a first long joint edge having a tongue and having a locking groove that is formed in an underside of and extends in parallel with the first long joint edge at a distance from the long joint plane, and a second long joint edge having a tongue groove, which cooperates with the tongue for providing vertical locking, and a projecting portion integrated with a floorboard body and projecting from a lower part of the second long joint edge, below the first long joint edge, said projecting portion being located entirely outside the long joint plane as seen from the side of the second long joint edge and supporting, at a distance from the long joint plane, a locking element which cooperates with the locking groove for providing the horizontal locking;

each pair of joined short edges comprises:

a first short joint edge having a tongue and having a locking groove that is formed in an underside of and extends in parallel with the first short joint edge at a distance from the short joint plane, and a second short joint edge having a tongue groove, which cooperates with the tongue for providing vertical locking, and a projecting portion integrated with a floorboard body and projecting from a lower part of the second short joint edge, below the first short joint edge, said projecting portion being located entirely outside the short joint plane as seen from the side of the second short joint edge and supporting, at a distance from the short joint plane, a locking element which cooperates with the locking groove for providing the horizontal locking;

said projecting portion of the second short joint edge has a material composition other than that of the floorboard body, and the projecting portion of the second short joint edge presents at least two horizontally juxtaposed parts which differ from each other in respect of at least one of material composition and material properties.

2. The floorboard system as claimed in claim 1, wherein said at least two horizontally juxtaposed parts of the projecting portion of the second short joint edge are located at different distances from the joint plane.

3. The floorboard system as claimed in claim 2, wherein said at least two horizontally juxtaposed parts comprise an inner part closest to the short joint plane and an outer part at a distance from the short joint plane.

4. The floorboard system as claimed in claim 3, wherein the inner part is formed at least partially of a worked part of the floorboard body.

5. The floorboard system as claimed in claim 4, wherein the inner part is formed of a worked part of the floorboard body and of a part of a separate strip.

6. The floorboard system as claimed in claim 5, wherein the strip is attached to said worked part of the floorboard body.

7. The floorboard system as claimed in claim 4, wherein said worked part of the floorboard body included in the inner part constitutes an extension of a lower part of the tongue groove of the second short joint edge.

8. The floorboard system as claimed in claim 5, wherein said worked part of the floorboard body included in the inner part constitutes an extension of a lower part of the tongue groove of the second short joint edge.

9. The floorboard system as claimed in claim 6, wherein said worked part of the floorboard body included in the inner part constitutes an extension of a lower part of the tongue groove of the second short joint edge.

10. The floorboard system as claimed in claim 3, wherein the inner part is formed entirely of a worked part of the floorboard body.

11. The floorboard system as claimed in claim 3, wherein a separate edge portion is attached to an edge of the floorboard body at the second short joint edge, and wherein the inner part is at least partially formed of said separate edge portion.

12. The floorboard system as claimed in claim 11, wherein the inner part is formed entirely of said separate edge portion.

13. The floorboard system as claimed in claim 11, wherein the separate edge portion forms at least a part of the outer part.

14. The floorboard system as claimed in claim 12, wherein the separate edge portion forms at least a part of the outer part.

15. The floorboard system as claimed in claim 11, wherein the separate edge portion is made of wood fibre.

16. The floorboard system as claimed in claim 12, wherein the separate edge portion is made of wood fibre.

17. The floorboard system as claimed in claim 13, wherein the separate edge portion is made of wood fibre.

18. The floorboard system as claimed in claim 11, wherein the edge portion is made of plywood.

19. The floorboard system as claimed in claim 12, wherein the edge portion is made of plywood.

20. The floorboard system as claimed in claim 13, wherein the edge portion is made of plywood.

21. The floorboard system as claimed in claim 12, wherein the separate edge portion is subjected to working in respect of form, with a view to forming part of the locking system.

22. The floorboard system as claimed in claim 13, wherein the separate edge portion is subjected to working in respect of form, with a view to forming part of the locking system.

23. The floorboard system as claimed in claim 15, wherein the separate edge portion is subjected to working in respect of form, with a view to forming part of the locking system.

24. The floorboard system as claimed in claim 18, wherein the separate edge portion is subjected to working in respect of form, with a view to forming part of the locking system.

25. The floorboard system as claimed in any one of claims 3, 5, 7, 10, 12, 15, and 21, wherein the outer part is at least partially formed of a separate strip, which separate strip is made of a material different from that of the floorboard body and which is integrally connected with the board by being factory-mounted.

26. The floorboard system as claimed in claim 5, wherein the strip is mechanically attached.

27. The floorboard system as claimed in claim 6, wherein the strip is mechanically attached.

28. The floorboard system as claimed in any one of claims 3, 5, 7, and 11, wherein the outer part is resilient in a direction transversely of the principal plane of the floorboards.

29. The floorboard system as claimed in claim 1, wherein the locking system provided on the joined long edges differs from the locking system provided on the joined short edges in respect of at least one of material composition and material properties.

30. A floorboard system comprising a plurality of floorboards, wherein each of the floorboards is a rectangular floorboard provided with long edges and short edges and a locking system for mechanical joining, both vertically and horizontally, the floorboards along the long edges as well as the short edges thereof, wherein immediately juxtaposed upper parts of each pair of joined long edges of the mechanically joined floorboards together define a long joint plane which is perpendicular to a principal plane of the joined floorboards; and each such pair of joined long edges comprises:

a first long joint edge having a tongue and having a locking groove that is formed in an underside of and extends in parallel with the first long joint edge, at a distance from the long joint plane, and a second long joint edge having a tongue groove, which cooperates with the tongue for providing the vertical locking, and a projecting portion integrated with a floorboard body and projecting from a lower part of the second long joint edge, below the first long joint edge, said projecting portion being located entirely outside the long joint plane as seen from the side of the second long joint edge and supporting, at a distance from the long joint plane, a locking element which cooperates with the locking groove for providing the horizontal locking;

wherein said projecting portion of the second long joint edge of the floorboard has a material composition other than that of the floorboard body, the projecting portion of the second long joint edge presents at least two horizontally juxtaposed parts, which differ from each other in respect of at least one of material composition and material properties, and said two parts are located at different distances from the long joint plane and comprise:

an inner part, closest to the long joint plane and an outer part, at a distance from the long joint plane, said inner part being formed of a worked part of the floorboard body and of a part of a separate strip, said worked part of the floorboard body, included in the inner part, defining an extension of a lower part of the tongue groove, and said strip being attached to said worked part of the floorboard body.

31. The floorboard system as claimed in claim 30, wherein the outer part of the projecting portion of the second long joint edge is at least partially formed of a separate strip, which is made of a material different from that of the floorboard body and which is integrally connected with the board by being factory-mounted.

32. The floorboard system as claimed in claim 30, wherein the strip intersects the long joint plane and extends under said second long joint edge.

33. The floorboard system as claimed in claim 31, wherein the strip intersects the long joint plane and extends under said second long joint edge.

34. The floorboard system as claimed in claim 30, wherein the strip is mechanically attached.

35. The floorboard system as claimed in claim 31, wherein the strip is mechanically attached.

36. The floorboard system as claimed in claim 32, wherein the strip is mechanically attached.

37. The floorboard system as claimed in claim 30, wherein the outer part is resilient in a direction transversely of the principal plane of the floorboards.

38. The floorboard system as claimed in claim 34, wherein the outer part is resilient in a direction transversely of the principal plane of the floorboards.

39. The floorboard system as claimed in claim 30, wherein the locking system provided on the long edges differ from a locking system provided on the short edges in respect of at least one of material composition and material properties.

40. The floorboard system as claimed claim 39, wherein each such pair of joined short edges includes a first short joint edge and a second short joint edge and the second short joint edge comprises a projecting portion integrated with the floorboard body and projecting from a lower part of the second short joint edge.

41. The floorboard system as claimed in claim 40, wherein the projecting portion of the second short joint edge is at least partially formed from an edge portion.

42. A rectangular floorboard as claimed in claim 40, wherein the projecting portion of the second short joint edge is formed in one piece with the floorboard body.

43. A floorboard system comprising a plurality of floorboards, wherein each of the plurality of floorboards is a rectangular floorboard provided with long edges and short edges and a locking system for mechanical joining, both vertically and horizontally, the floorboards along the long edges as well as the short edges thereof, each pair of joined long edges comprises:

a first long joint edge having a tongue and having a locking groove that is formed in an underside of and extends in parallel with the first long joint edge at a distance from the long joint plane, and a second long joint edge having a tongue groove, which cooperates with the tongue for providing vertical locking, and a projecting portion integrated with a floorboard body and projecting from a lower part of the second long joint edge, below the first long joint edge, said projecting portion being located entirely outside the long joint plane as seen from the side of the second long joint edge and supporting, at a distance from the long joint plane, a locking element which cooperates with the locking groove for providing the horizontal locking;

each pair of joined short edges comprises:

a first short joint edge having a tongue and having a locking groove that is formed in an underside of and extends in parallel with the first short joint edge at a distance from the short joint plane, and a second short joint edge having a tongue groove, which cooperates with the tongue for providing vertical locking, and a projecting portion integrated with a floorboard body and projecting from a lower part of the second short joint edge, below the first short joint edge, said projecting portion being located entirely outside the short joint plane as seen from the side of the second short joint edge and supporting, at a distance from the short joint plane, a locking element which cooperates with the locking groove for providing the horizontal locking;

said projecting portion of the second short joint edge of the floorboard is formed in one piece with the floorboard body, the projecting portion of the second short joint edge presents at least two horizontally juxtaposed parts, which differ from each other in respect of at least one of material composition and material properties.

44. A rectangular floorboard as claimed in claim 43, wherein said at least two parts are located at different distances from the short joint plane.

45. A rectangular floorboard as claimed in claim 44, wherein said at least two parts comprise an inner part closest to the short joint plane and an outer part at a distance from the short joint plane.

46. A rectangular floorboard as claimed in claim 43, wherein the floorboard body comprises a layered material.

47. A rectangular floorboard as claimed in claim 44, wherein the floorboard body comprises a layered material.

48. A rectangular floorboard as claimed in claim 45, wherein the floorboard body comprises a layered material.

49. A rectangular floorboard as claimed in claim 46, wherein the floorboard body comprises plywood.

50. A rectangular floorboard as claimed in claim 47, wherein the floorboard body comprises plywood.

51. A rectangular floorboard as claimed in claim 48, wherein the floorboard body comprises plywood.

52. A rectangular floorboard as claimed in claim 49, wherein said different material properties are provided in different plywood layers by varying the fibre direction in the different layers.

53. A rectangular floorboard as claimed in claim 50, wherein said different material properties are provided in different plywood layers by varying the fibre direction in the different layers.

54. A rectangular floorboard as claimed in claim 51, wherein said different material properties are provided in different plywood layers by varying the fibre direction in the different layers.

55. A rectangular floorboard as claimed in claim 45, wherein the projecting part further comprises, in addition to said horizontally juxtaposed inner and outer parts, an outermost part, located at a distance from the short joint plane.

56. A rectangular floorboard as claimed in claim 55, wherein the outermost part is limited, in a direction towards the joint plane, by a vertical plane which essentially coincides with an active locking surface of the locking element.

57. A rectangular floorboard as claimed in claim 55, wherein the inner part comprises a core material and a laminate, the outer part comprises a laminate and the outermost part comprises a core material and a laminate.

58. A rectangular floorboard as claimed in claim 56, wherein the inner part comprises a core material and a laminate, the outer part comprises a laminate and the outermost part comprises a core material and a laminate.

59. A rectangular floorboard as claimed in claim 57, wherein the outer part consists of the laminate only.

60. A rectangular floorboard as claimed in claim 58, wherein the outer part consists of the laminate only.

61. A rectangular floorboard as claimed in claim 57, wherein the outer part has been worked from above so that the laminate forms part of the active locking surface.

62. A rectangular floorboard as claimed in claim 59, wherein the outer part has been worked from above so that the laminate forms part of the active locking surface.

63. A rectangular floorboard as claimed in any one of claims 57–62, wherein the outermost part further comprises an intermediate layer.

64. A rectangular floorboard as claimed in claim 61, wherein the intermediate layer reinforces the active locking surface.

65. A rectangular floorboard as claimed in claim 62, wherein the intermediate layer reinforces the active locking surface.

66. A rectangular floorboard as claimed in any one of claims 56, 57, 59, and 61, wherein the inner part further comprises an intermediate layer.

67. A rectangular floorboard as claimed in claim 43, wherein the projecting portion of the second long joint edge of the floorboard has a material composition other than that of the floorboard body.

68. A rectangular floorboard as claimed in claim 67, wherein said projecting portion of said second long joint edge comprises an aluminum strip.

69. A floorboard system comprising a plurality of floorboards, wherein each of the floorboards is a rectangular floorboard provided with long edges and short edges and having a floorboard body provided with an integrated long edge locking system and an integrated short edge locking system for mechanical joining, both vertically and horizontally, the floorboards, along the long edges thereof and along the short edges thereof, respectively;

the long edge locking system differs from the short edge locking system in respect of at least one of material composition and material properties, and at least one of the long edge locking system and the short edge locking system comprises a separate element which is integrally connected with the floorboard body at the factory and is made of a material other than that included in the floorboard body.

70. The floorboard system as claimed in claim 69, wherein a part of the long edge locking system that is related to horizontal locking transversely of the long edges differs, in respect of at least one of material composition and material properties, from a part of the short edge locking system that is related to horizontal locking transversely of the short edges.

71. The floorboard system as claimed in claim 69, wherein said separate element is an edge portion, which is attached to the edge of the floorboard body and which extends over the height of the entire floorboard or part thereof.

72. The floorboard system as claimed in claim 70, wherein said separate element is an edge portion, which is attached to the edge of the floorboard body and which extends over the height of the entire floorboard or part thereof.

73. The floorboard system as claimed in claim 71, wherein said floorboard body comprises a top layer extending over the edge portion.

74. The floorboard system as claimed in claim 72, wherein said floorboard body comprises a top layer extending over the edge portion.

75. The floorboard system as claimed in claim 73, said floorboard body comprises a rear balance layer extending under the edge portion.

76. A floorboard system as claimed in any one of claims 71–74, wherein the edge portion has been subjected to working in respect of form, with a view to forming part of the locking system.

77. A floorboard system as claimed in any one of claim 75, wherein the edge portion has been subjected to working in respect of form, with a view to forming part of the locking system.

78. A floorboard system as claimed in any one of claims 71–75, wherein the edge portion has been subjected to working in respect of form, with a view to forming a projecting portion with a locking element.

79. A floorboard system as claimed in claim 76, wherein the edge portion has been subjected to working in respect of form, with a view to forming a projecting portion for supporting a locking element for engagement with a locking groove in an underside of an adjacent one of the floorboards.

80. A floorboard system as claimed in claim 76, wherein the edge portion has been subjected to working in respect of form, with a view to forming a tongue with a locking groove.

81. A floorboard system as claimed in claim 76, wherein the edge portion has been subjected to working in respect of form, with a view to forming a tongue with a locking groove for engagement with a locking element of a projecting portion of an adjacent one of the floorboards.

82. A floorboard system as claimed in claim 80, wherein the edge portion has been subjected to working in respect of form, with a view to forming a tongue with a locking groove for engagement with a locking element of a projecting portion of a n adjacent one of the floorboards.

83. A floorboard system as claimed in any one of claims 71, 73, 75, and 77, wherein the edge portion is made of wood fiber.

84. A floorboard system as claimed in any one of claims 71, 73, 75, and 77, wherein the edge portion is made of plywood.

85. A floorboard system as claimed in claim 69 or claim 70, wherein said separate element is associated with the short edge locking system and is arranged at one of the short edges of the floorboard.

86. A floorboard system as claimed in claim 69 or claim 70, wherein said long edge locking system is structured such that each pair of joined long edges comprises:

a first long edge having a tongue and a locking groove that is formed in an underside of and extends in parallel with the first long edge, and a second long edge having a tongue groove, which cooperates with the tongue for providing the vertical locking, and a projecting portion extending from a lower part of the second long edge and below the first long edge, and supporting a locking element which cooperates with the locking groove for providing the horizontal locking.

87. A floorboard system as claimed in claim 69 or claim 70, wherein said short edge locking system is structured such that each pair of joined short edges comprises:

a first short edge having a tongue and a locking groove that is formed in an underside of and extends in parallel with the first short edge, and a second short edge having a tongue groove, which cooperates with the tongue for providing the vertical locking, and a projecting portion extending from the lower part of the second short edge and below the first short edge, and supporting a locking element which cooperates with the locking groove for providing the horizontal locking.

88. A floorboard system as claimed in claim 69 or claim 70, wherein the long edge locking system is adapted such that said floorboard is mechanically joinable along its long edges with long edges of identical floorboards by downwards angling, and wherein the short edge locking system is adapted such that said floorboard is mechanically joinable along its short edges with short edges of identical floorboards by displacement along said long edges.

89. A floorboard system comprising a plurality of floorboards, wherein each of the floorboards is a rectangular floorboard provided with a floorboard body and long edges and short edges and provided with an integrated long edge locking system and an integrated short edge locking system for mechanical joining, both vertically and horizontally, the floorboards, along the long edges thereof and along the short edges thereof, respectively, the long edge locking system differs from the short edge locking system in respect of at least one of material composition and material properties, and at least one of the long edge locking system and the short edge locking system comprises an element, which is formed in one piece with the floorboard body.

90. A floorboard system as claimed in claim 89, wherein a part of the long edge locking system that is related to horizontal locking transversely of the long edges differs, in respect of at least one of the parameters material composition and material properties, from a part of the short edge locking system that is related to horizontal locking transversely of the short edges.

91. A floorboard system as claimed in claim 89, wherein the long edge locking system and the short edge locking system both comprise an element which is formed in one piece with the floorboard body.

92. A floorboard system as claimed in claim 90, wherein the long edge locking system and the short edge locking system both comprise an element which is formed in one piece with the floorboard body.

93. A floorboard system as claimed in claims 89–92, wherein the floorboard body comprises a layered material.

94. A floorboard system as claimed in claim 93, wherein the floorboard body comprises plywood.

95. A floorboard system as claimed in claim 94, wherein different material properties are provided in different layers by varying a direction of fibers in the different layers.

96. A floorboard system as claimed in claim 89, wherein said element, which is formed in one piece with the floorboard body, is associated with the short edge locking system and is arranged at one of the short edges of the floorboard.

97. A floorboard system as claimed in claim 89, wherein said element, which is formed in one piece with the floorboard body, is associated with the long edge locking system and is arranged at one of the long edges of the floorboard.

98. A floorboard system as claimed in claim 89, wherein said long edge locking system is structured such that each pair of joined long edges comprises:

a first long edge having a tongue and a locking groove that is formed in an underside of and extends in parallel with the first long edge, and a second long edge having a tongue groove, which cooperates with the tongue for providing the vertical locking, and a projecting portion extending from a lower part of the second long edge and below the first long edge, and supporting a locking element which cooperates with the locking groove for providing the horizontal locking.

99. A floorboard system as claimed in claim 89, wherein said short edge locking system is structured such that each pair of joined short edges comprises:

a first short edge having a tongue and a locking groove that is formed in an underside of and extends in parallel with the first short edge, and a second short edge having a tongue groove, which cooperates with the tongue for providing the vertical locking, and a projecting portion extending from a lower part of the second short edge and below the first short edge, and supporting a locking element which cooperates with the locking groove for providing the horizontal locking.

100. A floorboard system as claimed in claim 97, wherein said short edge locking system is structured such that each pair of joined short edges comprises:

a first short edge having a tongue and a locking groove that is formed in an underside of and extends in parallel with the first short edge, and a second short edge having a tongue groove, which cooperates with the tongue for providing the vertical locking, and a projecting portion extending from a lower part of the second short edge and below the first short edge, and supporting a locking element which cooperates with the locking groove for providing the horizontal locking.

101. A floorboard system as claimed in claim 99, wherein the projecting portion of the long edge locking system is worked to a different degree than the projecting portion of the short edge locking system, thus providing different material properties or material composition in the long edge locking system than in the short edge locking system.

102. A floorboard system as claimed in claim 100, wherein the long edge locking system is adapted such that said floorboard is mechanically joinable along its long edges with long edges of identical floorboards by downwards angling, and wherein the short edge locking system is adapted such that said floorboard is mechanically joinable along its short edges with short edges of identical floorboards by displacement along said long edges.

* * * * *